US012716111B2

(12) United States Patent
Mitsunobu et al.

(10) Patent No.: US 12,716,111 B2
(45) **Date of Patent: *Aug. 25, 2026**

(54) STEEL SHEET AND PLATED STEEL SHEET

(71) Applicant: NIPPON STEEL CORPORATION, Tokyo (JP)

(72) Inventors: Takuya Mitsunobu, Tokyo (JP); Keitaro Matsuda, Tokyo (JP); Jun Maki, Tokyo (JP); Takehiro Takahashi, Tokyo (JP); Hiroshi Takebayashi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 370 days.

This patent is subject to a terminal disclaimer.

(21) Appl. No.: 18/288,201

(22) PCT Filed: Apr. 27, 2021

(86) PCT No.: PCT/JP2021/016827

§ 371 (c)(1),
(2) Date: Oct. 25, 2023

(87) PCT Pub. No.: WO2022/230059

PCT Pub. Date: Nov. 3, 2022

(65) Prior Publication Data

US 2024/0240278 A1 Jul. 18, 2024

(51) Int. Cl.
*C21D 9/46* (2006.01)
*C22C 38/00* (2006.01)
(Continued)

(52) U.S. Cl.
CPC ..... *C21D 9/46* (2013.01); *C22C 38/001* (2013.01); *C22C 38/002* (2013.01); *C22C 38/02* (2013.01);
(Continued)

(58) Field of Classification Search
None
See application file for complete search history.

(56) References Cited

U.S. PATENT DOCUMENTS

2015/0329946 A1* 11/2015 Yasui ..... C23C 28/345
148/533
2016/0160335 A1 6/2016 Ikeda
(Continued)

FOREIGN PATENT DOCUMENTS

JP 4-202632 A 7/1992
JP 2007-211279 A 8/2007
(Continued)

*Primary Examiner* — Seth Dumbris
(74) *Attorney, Agent, or Firm* — Birch, Stewart, Kolasch & Birch, LLP

(57) ABSTRACT

A steel sheet comprising, by mass %, C: 0.05 to 0.40%, Si: 0.2 to 3.0%, and Mn: 0.1 to 5.0%, wherein a surface layer of the steel sheet contains granular oxides, an average grain size of the granular oxides is 300 nm or less, a number density of granular oxides is 4.0/μm$^2$ or more, the steel sheet comprises an Si—Mn depleted layer having a thickness of 3.0 μm or more from the surface of the steel sheet, and Si and Mn contents of the Si—Mn depleted layer not containing oxides at the ½ position of the thickness are respectively less than 10% of the Si and Mn contents at the sheet thickness center part of the steel sheet, and a plated steel sheet using the same are provided.

16 Claims, 2 Drawing Sheets

(51) Int. Cl.

| | |
|---|---|
| ***C22C 38/02*** | (2006.01) |
| ***C22C 38/04*** | (2006.01) |
| ***C23C 2/06*** | (2006.01) |
| ***C23C 2/40*** | (2006.01) |

(52) U.S. Cl.
CPC ..... *C22C 38/04* (2013.01); *C23C 2/06* (2013.01); *C23C 2/40* (2013.01)

(56) References Cited

U.S. PATENT DOCUMENTS

| | | | | |
|---|---|---|---|---|
| 2017/0369965 | A1 | 12/2017 | Ikeda et al. | |
| 2017/0369974 | A1* | 12/2017 | Kim | C21D 8/0226 |
| 2018/0002799 | A1 | 1/2018 | Futamura et al. | |
| 2020/0001342 | A1* | 1/2020 | Toda | C23C 2/06 |
| 2023/0002845 | A1* | 1/2023 | Kang | C22C 38/38 |

FOREIGN PATENT DOCUMENTS

| | | | |
|---|---|---|---|
| JP | 2013-60630 | A | 4/2013 |
| JP | 2016-130356 | A | 7/2016 |
| JP | 2016-130357 | A | 7/2016 |
| JP | 2018-193614 | A | 12/2018 |
| KR | 10-2015-0088310 | A | 7/2015 |

* cited by examiner

STEEL SHEET AND PLATED STEEL SHEET

FIELD

The present invention relates to a steel sheet and plated steel sheet. More specifically, the present invention relates to a high strength steel sheet and plated steel sheet having high plateability, LME resistance, and hydrogen embrittlement resistance.

BACKGROUND

In recent years, steel sheets used in automobiles, household electrical appliances, building materials, and other various fields have been made increasingly higher in strength. For example, the use of a high strength steel sheet has increased in the field of automobiles for the purpose of reducing vehicle body weight to improve fuel economy. Such a high strength steel sheet typically includes elements such as C, Si, and Mn to improve the strength of the steel.

In the production of a high strength steel sheet, heat treatment such as annealing is generally performed after rolling. Furthermore, among the elements typically included in the high strength steel sheet, the easily oxidizable elements of Si and Mn may bond with the oxygen in the atmosphere during the heat treatment and sometimes form an oxide-including layer in the vicinity of the surface of the steel sheet. The forms that such a layer takes include a form in which oxides including Si or Mn form a film on the outside (surface) of the steel sheet (external oxidation layer) and a form in which the oxides are formed on the inside (surface layer) of the steel sheet (internal oxidation layer).

When forming a plating layer (for example, a Zn-based plating layer) on the surface of a steel sheet having an external oxidation layer, oxides will be present as a film on the surface of the steel sheet and will therefore impede interdiffusion between the steel constituents (for example, Fe) and plating constituents (for example, Zn) thereby affecting the adhesion between the steel and the plating, sometimes resulting in insufficient plateability (for example, there will be an increase in non-plated parts). Therefore, from the viewpoint of improving plateability, a steel sheet formed with an internal oxidation layer is more preferable than a steel sheet formed with an external oxidation layer.

In relation to internal oxidation layers, PTLs 1 and 2 describe a high strength plated steel sheet with a tensile strength of 980 MPa or more comprised of a plated steel sheet having a zinc-based plating layer on a base steel sheet including C, Si, Mn, etc., and having an internal oxidation layer including an oxide of Si and/or Mn on a surface layer of the base steel sheet.

Further, PTL 3 proposes a method of production of high strength hot dip galvanized steel sheet of high Si content steel suitably controlling the annealing conditions, since, in the case of high Si content steel having a concentration of Si in the steel of 0.3% or more, the Si etc. in the steel diffuses to the surface layer of the steel sheet as oxides due to heating of the surface of the steel sheet and these oxides obstruct the wettability of the plating and worsen the plating adhesion.

CITATIONS LIST

Patent Literature

[PTL 1] Japanese Unexamined Patent Publication No. 2016-130357

[PTL 2] Japanese Unexamined Patent Publication No. 2018-193614

[PTL 3] Japanese Unexamined Patent Publication No. 4-202632

SUMMARY

Technical Problem

A high strength steel sheet used for automotive members, etc., are sometimes used in corrosive atmospheric environments in which the temperature and humidity fluctuate greatly. It is known that if the high strength steel sheet is exposed to such a corrosive atmospheric environment, hydrogen generated in the process of corrosion will penetrate into the steel. The hydrogen penetrating the steel will segregate at the martensite grain boundaries in the steel microstructure and make the grain boundaries brittle to thereby possibly cause cracks in the steel sheet. The phenomenon of cracks being caused due to this penetrated hydrogen is called "hydrogen embrittlement cracking" (delayed cracking) and often becomes a problem during working of the steel sheet. Accordingly, to prevent hydrogen embrittlement cracking, in the steel sheet used in corrosive environments, it is effective to reduce the amount of hydrogen buildup in the steel.

Furthermore, in the case of hot stamping or welding a plated steel sheet comprising a high strength steel sheet provided with a Zn-based plating layer, etc., the plated steel sheet is worked at a high temperature (for example, about 900° C.), and therefore can possibly be worked in a state in which the Zn included in the plating layer has melted. In this case, the molten Zn will sometimes penetrate into the steel and cause cracks inside the steel sheet. This phenomenon is called "liquid metal embrittlement (LME)". It is known that the fatigue properties of the steel sheet degrade due to this LME. Accordingly, to prevent LME cracking, it is effective to keep the Zn, etc., included in the plating layer from penetrating into the steel sheet.

PTLs 1 and 2 teach that by controlling the average depth of the internal oxidation layer to a thick 4 μm or more and having the internal oxidation layer function as hydrogen trap sites by the method of oxidation in the oxidation zone by a 0.9 to 1.4 air ratio or air-fuel ratio and then reduction of the oxide film in a hydrogen atmosphere in the reduction zone, it is possible to prevent penetration of hydrogen and suppress hydrogen embrittlement. PTL 3 similarly specifically discloses heating in the oxidation zone by a 0.95 to 1.10 air ratio. However, in each of these documents, controlling the form of the oxides present in the internal oxidation layer has not been studied at all. There is still room for improvement of hydrogen embrittlement resistance. Furthermore, improvement of LME resistance has not been studied.

In consideration of these circumstances, the object of the present invention is to provide a high strength steel sheet and plated steel sheet having high plateability, LME resistance, and hydrogen embrittlement resistance.

Solution to Problem

The inventors discovered that to solve the above problem it is important to form oxides in the surface layer of the steel sheet, i.e., on the inside of the steel sheet, and furthermore, to control the form of the oxides present in the surface layer of the steel sheet and also to control the Si—Mn depleted layer formed at the surface layer of the steel sheet due to formation of such oxides to within predetermined ranges of thickness and composition. In further detail, the inventors discovered that high LME resistance and hydrogen embrittlement resistance could be achieved by forming internal oxides to secure high plateability and forming, as the form of oxides, granular oxides present inside the crystal grains of the metallographic structure by a sufficient fineness and large amount so that the granular oxides are made to not only function as trap sites for hydrogen which could penetrate the steel in corrosive environments but also function as trap sites for Zn which could penetrate the steel during hot stamping or welding and forming an Si—Mn depleted layer having a predetermined thickness and composition on the surface layer of the steel sheet to thereby promote hydrogen diffusion in the steel and improve the dischargeability of hydrogen from inside the steel.

The present invention is based on the above findings and has as its gist the following:

(1) A steel sheet having a chemical composition comprising, by mass %,
C: 0.05 to 0.40%,
Si: 0.2 to 3.0%,
Mn: 0.1 to 5.0%,
sol. Al: 0 to less than 0.4000%,
P: 0.0300% or less,
S: 0.0300% or less,
N: 0.0100% or less,
B: 0 to 0.010%,
Ti: 0 to 0.150%,
Nb: 0 to 0.150%,
V: 0 to 0.150%,
Cr: 0 to 2.00%,
Ni: 0 to 2.00%,
Cu: 0 to 2.00%,
Mo: 0 to 1.00%,
W: 0 to 1.00%,
Ca: 0 to 0.100%,
Mg: 0 to 0.100%,
Zr: 0 to 0.100%,
Hf: 0 to 0.100%,
REM: 0 to 0.100% and
a balance of Fe and impurities, wherein
a surface layer of the steel sheet contains granular oxides,
an average grain size of the granular oxides is 300 nm or less,
a number density of the granular oxides is 4.0/μm$^2$ or more,
the steel sheet comprises an Si—Mn depleted layer having a thickness of 3.0 μm or more from the surface of the steel sheet, and
Si and Mn contents of the Si—Mn depleted layer at ½ position of the thickness and not containing oxides are respectively less than 10% of the Si and Mn contents at a sheet thickness center part of the steel sheet.

(2) The steel sheet according to (1), wherein the average grain size of the granular oxides is 200 nm or less.

(3) The steel sheet according to (1) or (2), wherein the number density of the granular oxides is 10.0/μm$^2$ or more.

(4) The steel sheet according to any one of (1) to (3), wherein the surface layer of the steel sheet further contains grain boundary oxides.

(5) The steel sheet according to (4), wherein, when examining a cross-section of the surface layer of the steel sheet, a Ratio A of a length of the grain boundary oxides projected on the surface of the steel sheet to a length of the surface of the steel sheet is 50% or more.

(6) The steel sheet according to (5), wherein the Ratio A is 80% or more.

(7) A plated steel sheet having a plating layer including Zn on the steel sheet of any one of (1) to (6).

(8) The plated steel sheet according to (7) wherein the plating layer has a chemical composition of Zn-(0.3 to 1.5)% Al.

Advantageous Effects of Invention

According to the present invention, the granular oxides present in a fine size and large amount in the surface layer of the steel sheet can be made to function as trap sites for hydrogen penetrating the steel sheet in corrosive environments. As a result, the amount of hydrogen penetrating it in a corrosive environment can be greatly suppressed and the hydrogen embrittlement resistance can be greatly improved. Furthermore, the granular oxides also function as trap sites for Zn penetrating the steel during hot stamping or welding. The amount of Zn penetrating it can be greatly suppressed and the LME resistance can be greatly improved. Moreover, according to the present invention, by including an Si—Mn depleted layer having a predetermined thickness and composition, it becomes possible to promote the diffusion of hydrogen and improve the dischargeability of hydrogen from inside the steel. As a result, it is possible to discharge the penetrated hydrogen and reduce the amount of hydrogen built up in the steel and possible to greatly improve the hydrogen embrittlement resistance. Finally, because the granular oxides and optional grain boundary oxides are formed at the inside of the steel sheet, when forming the plating layer, the steel constituents and plating constituents sufficiently interdiffuse making it possible to achieve high plateability. Accordingly, through the present invention, it is possible to achieve high plateability, LME resistance, and hydrogen embrittlement resistance in a high strength steel sheet.

DESCRIPTION OF EMBODIMENTS

<Steel Sheet>

The steel sheet according to the present invention has a chemical composition comprising, by mass %,
C: 0.05 to 0.40%,
Si: 0.2 to 3.0%, Mn: 0.1 to 5.0%,
sol. Al: 0 to less than 0.4000%,
P: 0.0300% or less,
S: 0.0300% or less,
N: 0.0100% or less,
B: 0 to 0.010%,
Ti: 0 to 0.150%,
Nb: 0 to 0.150%,
V: 0 to 0.150%,
Cr: 0 to 2.00%,
Ni: 0 to 2.00%,
Cu: 0 to 2.00%,
Mo: 0 to 1.00%,
W: 0 to 1.00%,
Ca: 0 to 0.100%,
Mg: 0 to 0.100%,
Zr: 0 to 0.100%,
Hf: 0 to 0.100%,
REM: 0 to 0.100% and
a balance of Fe and impurities, wherein
a surface layer of the steel sheet contains granular oxides,
an average grain size of the granular oxides is 300 nm or less,
a number density of the granular oxides is 4.0/$\mu m^2$ or more,
the steel sheet comprises an Si—Mn depleted layer having a thickness of 3.0 μm or more from the surface of the steel sheet, and
Si and Mn contents of the Si—Mn depleted layer at ½ position of the thickness and not containing oxides are respectively less than 10% of the Si and Mn contents at a sheet thickness center part of the steel sheet.

In the production of a high strength steel sheet, a steel slab adjusted to a predetermined chemical composition is rolled (typically, hot rolled and cold rolled), then generally annealed for the purpose of obtaining the desired microstructure, etc. In the annealing, the comparatively easily oxidizable constituents in the steel sheet (for example, Si and Mn) bond with the oxygen in the annealing atmosphere whereby a layer including oxides is formed in the vicinity of the surface of the steel sheet. For example, like the steel sheet 1 shown in FIG. 1, an external oxidation layer 2 is formed as a film on the surface of the base steel 3 (i.e., the outside of the base steel 3). If an external oxidation layer 2 is formed as a film on the surface of the base steel 3, in the case of forming a plating layer (for example, zinc-based plating layer), the external oxidation layer 2 will impede interdiffusion between the plating constituents (for example, Zn, Al) and steel constituents (for example, Fe), and therefore sometimes sufficient adhesion between the steel and plating cannot be secured and non-plated parts where no plating layer is formed will arise.

Figure 1:
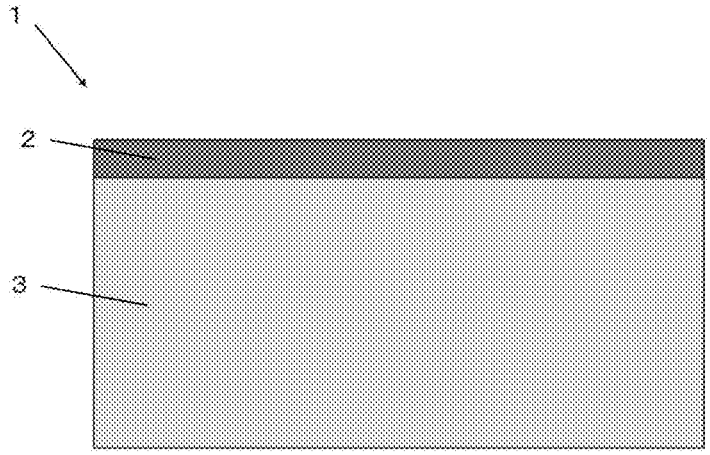
FIG. 1 is a schematic view of a cross-section of a steel sheet having an external oxidation layer.
Figure 2:
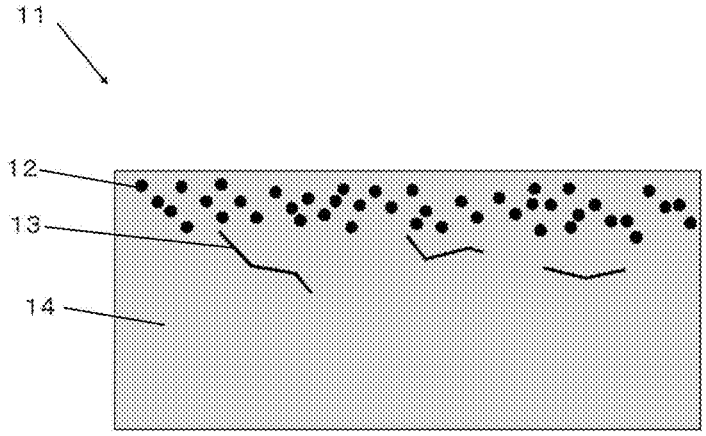
FIG. 2 is a schematic view of a cross-section of the steel sheet according to one embodiment of the present invention.

In contrast, as illustrated in FIG. 2, the steel sheet 11 according to the present invention does not have an external oxidation layer 2 formed on the surface of the base steel 3 like the steel sheet 1 shown in FIG. 1, but has granular oxides 12 present at the inside of the base steel 14 and optionally has grain boundary oxides 13 present at the crystal grain boundaries of the metallographic structure. Accordingly, when forming a plating layer on the surface of the steel sheet 11, the steel sheet 11 according to the present invention in which granular oxides 12 and optional grain boundary oxides 13 are formed inside of the base steel 14 can achieve sufficient interdiffusion between the plating constituents and steel constituents and can obtain high plateability in comparison to steel sheet 1 having an external oxidation layer 2. Therefore, the inventors discovered that from the viewpoint of achieving high plateability, it is effective to control the conditions during annealing to form oxides at the inside of the steel sheet. The term "high plateability", when used regarding a steel sheet, means that when plating the steel sheet, it is possible to form a plating layer in a state in which there are few non-plated parts (parts where the plating layer is not formed) (for example, 5.0 area % or less) or none at all. Further, the term "high plateability", when used regarding a plated steel sheet, means a plated steel sheet in a state with extremely few non-plated parts (for example, 5.0 area % or less) or none at all.

Further, a high strength steel sheet used in an atmospheric environment, particularly a high strength steel sheet for automobiles, is repeatedly exposed and used in various environments of differing temperature and humidity. Such an environment is called a "corrosive atmospheric environment". It is known that hydrogen is generated in the process of corrosion in the corrosive atmospheric environment. Moreover, the hydrogen penetrates deeper than the surface layer region in the steel and segregates at the martensite grain boundaries of the steel sheet microstructure thereby causing embrittlement of the grain boundaries and triggering hydrogen embrittlement cracking (delayed cracking) in the steel sheet. Martensite is a hard structure, and therefore has a high hydrogen susceptibility and is more vulnerable to hydrogen embrittlement cracking. Such cracking can become a problem when working steel sheet. Accordingly, to prevent hydrogen embrittlement cracking, in a high strength steel sheet used in a corrosive atmospheric environment, it is effective to reduce the amount of hydrogen built up in the steel, more specifically, the amount of hydrogen built up at positions deeper than the surface layer region of the steel sheet. The inventors discovered that by controlling the form of oxides present at the surface layer of a steel sheet, more specifically, by making the oxides inside of the steel sheet "granular oxides" having an average grain size and number density in predetermined ranges and, further, controlling the Si—Mn depleted layer formed due to the drop in the Si and Mn concentrations of the surroundings caused by the formation of such internal oxides to within predetermined ranges of thickness and composition, the granular oxides function as trap sites for hydrogen penetrating the steel sheet at the surface layer region of the steel sheet in a corrosive environment and the Si—Mn depleted layer promotes diffusion of penetrating hydrogen to improve the discharge of hydrogen from inside the steel and that as a result, the amount of hydrogen built up in the steel sheet used in a corrosive environment can be reduced not only by suppression of penetration of hydrogen, but also promotion of discharge of penetrated hydrogen to the outside of the system. The term "high hydrogen embrittlement resistance" means a state in which the amount of hydrogen built up in steel sheet or plated steel sheet is reduced enough so that hydrogen embrittlement cracking can be sufficiently suppressed.

The inventors analyzed in detail the relationship between the form of the oxides and their effectiveness as trap sites for hydrogen. As a result, they discovered that, as shown in FIG. 2, it was effective to have the granular oxides 12 dispersed as grains in the surface layer of the base steel 14 be present separated from each other in a fine size and large amounts, more specifically to have the granular oxides be present with an average grain size of 300 nm or less and a number density of 4.0/$\mu m^2$ or more. While not being bound to any specific theory, the function of the oxides in the steel sheet of trapping penetrating hydrogen is believed to have a positive correlation with the surface area of the oxides. That is, it is believed that by the oxides being dispersed separated from each other in a fine size and a large amount at the surface layer of the steel sheet, the surface area of the oxides at the surface layer of the steel sheet increases and the hydrogen trap function is improved. Therefore, the inventors discovered that it is important, from the viewpoint of achieving high hydrogen penetration resistance and in turn to obtain high hydrogen embrittlement resistance, to control conditions at the time of production of the steel sheet, particularly at the time of annealing, so that granular oxides functioning as trap sites for hydrogen penetrating the steel in a corrosive environment are present in a fine size and large amount. The metallographic structure of the surface layer of the steel sheet is typically constituted by a metallographic structure softer than the inside of the steel sheet (for example, at a ⅛ position or ¼ position of the thickness), and therefore even if there is hydrogen at the surface layer of the steel sheet, hydrogen embrittlement cracking will not particularly be a problem.

Further, the inventors analyzed in detail the relationship between the form of the Si—Mn depleted layer formed due to the drop in the concentrations of Si and Mn in the surroundings caused by the formation of granular oxides 12 and other internal oxides such as shown in FIG. 2 and the dischargeability of hydrogen and as a result discovered that it was effective to control the Si—Mn depleted layer to predetermined ranges of thickness and composition, more specifically make the thickness of the Si—Mn depleted layer 3.0 μm or more from the surface of the steel sheet and control the Si and Mn contents of the Si—Mn depleted layer not containing oxides at the ½ position of the thickness to become respectively less than 10% of the Si and Mn contents at the sheet thickness center part of the steel sheet (below, these values will also be referred to as the "Si depletion rate" and the "Mn depletion rate"). While not being bound by any specific theory, in the case of steel containing a large amount of Si and/or Mn, the Si and/or Mn dissolved in the steel similarly become greater as well, and therefore it is believed these dissolved Si and/or Mn obstruct diffusion of hydrogen and as a result the speed of diffusion of hydrogen in the steel becomes slower. As shown in FIG. 2, if granular oxides 12 and optional grain boundary oxides 13 and other internal oxides are formed at the surface layer of the steel sheet, the Si and Mn which had dissolved in the steel are consumed in the form of internal oxides, and therefore at the surface layer of the steel sheet, internal oxides are formed and an Si—Mn depleted layer in which the concentrations of Si and Mn relatively fall is formed in the surroundings. Therefore, by making the Si—Mn depleted layer relatively thick, specifically by controlling the thickness of the Si—Mn depleted layer to 3.0 μm or more from the surface of the steel sheet (if there is a plating layer present on the surface of the steel sheet, the interface of the plating layer and steel sheet), it is believed possible to sufficiently secure diffusion routes for the hydrogen while by further making the Si and Mn contents of the Si—Mn depleted layer sufficiently low, specifically by controlling the Si and Mn depletion rates to respectively less than 10%, it is believed possible to sufficiently reduce the amount of dissolved Si and Mn impeding diffusion of hydrogen. Therefore, by including an Si—Mn depleted layer controlled in thickness and composition to the above ranges, it is believed to become possible to promote the diffusion of hydrogen and remarkably improve the dischargeability of hydrogen from inside the steel. Accordingly, by combining the above-mentioned granular oxides and the Si—Mn depleted layer to thereby improve both the hydrogen penetration resistance and hydrogen dischargeability, it becomes possible to extremely greatly improve the hydrogen embrittlement resistance of the steel sheet as a whole.

Further, it is known that hydrogen embrittlement cracking sometimes occurs not only when using a high strength steel sheet such as explained above in a corrosive atmospheric environment, but also in annealing at the time of producing the high strength steel sheet due to hydrogen present in the annealing atmosphere penetrating deeper than the surface layer region of the base steel. At this time, the inventors discovered that the combination of the granular oxides and Si—Mn depleted layer acts effectively not only for use in a corrosive atmospheric environment, but also for suppression of penetration of hydrogen into the steel sheet at the time of annealing in the production process and for discharge of the penetrating hydrogen and as a result high hydrogen embrittlement resistance can be achieved both at the time of production of steel sheet and at the time of its use.

On the other hand, when hot stamping or welding a plated steel sheet that has a plating layer including Zn provided on the steel sheet surface, because of the high temperature during working, sometimes the Zn included in the plating layer will melt. If the Zn melts, the molten Zn will penetrate the steel. If working is performed in that state, sometimes liquid metal embrittlement (LME) cracking will occur inside of the steel sheet and the fatigue properties of the steel sheet will degrade due to the LME. The inventors discovered that if the granular oxides have the desired average grain size and number density, they can contribute not only to improving hydrogen embrittlement resistance but also improving LME resistance. In further detail, they discovered that the granular oxides function as trap sites for Zn trying to penetrate the steel during working at a high temperature. Due to this, Zn trying to penetrate the steel during, for example, hot stamping, is trapped by the granular oxides at the surface layer of the steel sheet and penetration of Zn into the crystal grain boundaries is suitably suppressed.

Accordingly, they discovered that not only for improving the above-mentioned hydrogen penetration resistance but also improving the LME resistance, it is important for granular oxides to be made present in a fine size and a large amount. The steel sheet according to the present invention is not necessarily limited to such a plated steel sheet and also encompasses a steel sheet which is not plated. The reason is that even a steel sheet which is not plated can suffer from LME cracking for example at the time of spot welding it with galvanized steel sheet due to zinc melting in the galvanized steel sheet penetrating the steel sheet which is not plated.

Below; the steel sheet according to the present invention will be explained in detail. The thickness of the steel sheet according to the present invention is not particularly limited but may be, for example, 0.1 to 3.2 mm.

[Chemical Composition of Steel Sheet]

The chemical composition contained in the steel sheet according to the present invention will be explained next. The "%" regarding content of the elements, unless otherwise stated, will mean "mass %". In the numerical ranges in the chemical composition, a numerical range expressed using "to", unless otherwise indicated, will mean a range having the numerical values before and after the "to" as the lower limit value and the upper limit value.

(C: 0.05 to 0.40%)

C (carbon) is an important element for securing the strength of steel. To secure sufficient strength and furthermore obtain the desired form of the internal oxides, the C content is 0.05% or more. The C content is preferably 0.07% or more, more preferably 0.10% or more, even more preferably 0.12% or more. On the other hand, if the C content is excessive, the weldability is liable to fall. Accordingly, the C content is 0.40% or less. The C content may also be 0.38% or less, 0.35% or less, 0.32% or less, or 0.30% or less.

(Si: 0.2 to 3.0%)

Si (silicon) is an element effective for improving the strength of steel. To secure sufficient strength and furthermore sufficiently cause the formation of the desired oxides, in particular, granular oxides inside the steel sheet, the Si content is 0.2% or more. The Si content is preferably 0.3% or more, more preferably 0.5% or more, further preferably 1.0% or more. On the other hand, if the Si content is excessive, external oxides are excessively formed and in turn deterioration of the surface properties is liable to be triggered. Furthermore, coarsening of the granular oxides is liable to be invited. Accordingly, the Si content is 3.0% or less. The Si content may also be 2.8% or less, 2.5% or less, 2.3% or less, or 2.0% or less.

(Mn: 0.1 to 5.0%)

Mn (manganese) is an element effective for obtaining hard structures to improve the strength of steel. To secure sufficient strength and further make the desired oxides, in particular granular oxides, sufficiently form inside of the steel sheet, the Mn content is 0.1% or more. The Mn content is preferably 0.5% or more, more preferably 1.0% or more, further preferably 1.5% or more. On the other hand, if the Mn content is excessive, external oxides will be excessively formed, the metallographic structure is liable to become uneven due to Mn segregation, and the workability is liable to decline. Furthermore, coarsening of the granular oxides is liable to be invited. Accordingly, the Mn content is 5.0% or less. The Mn content may also be 4.5% or less, 4.0% or less, 3.5% or less, or 3.0% or less.

(Sol. Al: 0 to Less than 0.4000%)

Al (aluminum) is an element which acts as a deoxidizing element. The Al content may also be 0%, but to obtain a sufficient deoxidizing effect, the Al content is preferably 0.0010% or more. The Al content is more preferably 0.0050% or more, further preferably 0.0100% or more, further more preferably 0.0150% or more. On the other hand, if the Al content is excessive, it is liable to trigger a reduction in the workability or a deterioration in surface properties. Therefore, the Al content is less than 0.4000%. The Al content may be 0.3900% or less, 0.3800% or less, 0.3700% or less, 0.3500% or less, 0.3400% or less, 0.3300% or less, 0.3000% or less, or 0.2000% or less. The Al content means the content of so-called acid-soluble Al (sol. Al).

(P: 0.0300% or Less)

P (phosphorus) is an impurity generally contained in steel. If excessively containing P, the weldability is liable to decline. Accordingly, the P content is 0.0300% or less. The P content is preferably 0.0200% or less, more preferably 0.0100% or less, even more preferably 0.0050% or less. The lower limit of the P content is 0%, but from the viewpoint of production costs, the P content may be more than 0% or be 0.0001% or more.

(S: 0.0300% or Less)

S (sulfur) is an impurity generally contained in steel. If excessively containing S, the weldability is liable to decline and further the amount of precipitated MnS is liable to increase and the bendability or other workability is liable to fall. Accordingly, the S content is 0.0300% or less. The S content is preferably 0.0100% or less, more preferably 0.0050% or less, even more preferably 0.0020% or less. The lower limit of the S content is 0%, but from the viewpoint of desulfurization costs, the S content may be more than 0% or be 0.0001% or more.

(N: 0.0100% or Less)

N (nitrogen) is an impurity generally contained in steel. If excessively containing N, the weldability is liable to decline. Accordingly, the N content is 0.0100% or less. The N content is preferably 0.0080% or less, more preferably 0.0050% or less, even more preferably 0.0030% or less. The lower limit of the N content is 0%, but from the viewpoint of production costs, the N content may be more than 0% or be 0.0010% or more.

The basic chemical composition of the steel sheet according to the present invention is as explained above. Furthermore the steel sheet may contain, in accordance with need, the following optional elements. Inclusion of these elements is not essential. The lower limits of contents of these elements are 0%.

(B: 0 to 0.010%)

B (boron) is an element which contributes to increasing hardenability and improving strength and further segregates at the grain boundaries to strengthen the grain boundaries and improve toughness. The B content may be 0%, but may be included in accordance with need so as to obtain the above effect. The B content may be 0.0001% or more, 0.0005% or more, or 0.001% or more. On the other hand, from the viewpoint of securing sufficient toughness and weldability, the B content is preferably 0.010% or less and may be 0.008% or less or 0.006% or less as well.

(Ti: 0 to 0.150%)

Ti (titanium) is an element which precipitates during cooling of steel as TiC and contributes to improving strength. The Ti content may be 0%, but may be included in accordance with need so as to obtain the above effect. The Ti content may be 0.001% or more, 0.003% or more, 0.005% or more, or 0.010% or more. On the other hand, if excessively containing Ti, coarse TiN is formed and the toughness is liable to be harmed. For this reason, the Ti content is preferably 0.150% or less and may also be 0.100% or less or 0.050% or less.

(Nb: 0 to 0.150%)

Nb (niobium) is an element which contributes to improving strength through improving hardenability. The Nb content may be 0%, but may be included in accordance with need so as to obtain the above effect. The Nb content may be 0.001% or more, 0.005% or more, 0.010% or more, or 0.015% or more. On the other hand, from the viewpoint of securing sufficient toughness and weldability, the Nb content is preferably 0.150% or less and may also be 0.100% or less or 0.060% or less.

(V: 0 to 0.150%)

V (vanadium) is an element which contributes to improving strength through improving hardenability. The V content may be 0%, but may be included in accordance with need so as to obtain the above effect. The V content may be 0.001% or more, 0.010% or more, 0.020% or more, or 0.030% or more. On the other hand, from the viewpoint of securing sufficient toughness and weldability, the V content is preferably 0.150% or less and may be 0.100% or less or 0.060% or less.

(Cr: 0 to 2.00%)

Cr (chromium) is effective for increasing the hardenability of steel and increasing the strength of steel. The Cr content may be 0%, but may be included in accordance with need so as to obtain the above effect. The Cr content may be 0.01% or more, 0.10% or more, 0.20% or more, 0.50% or more, or 0.80% or more. On the other hand, if excessively containing Cr, Cr carbides are formed in a large amount and conversely the hardenability is liable to be harmed, so the Cr content is preferably 2.00% or less and may be 1.80% or less or 1.50% or less.

(Ni: 0 to 2.00%)

Ni (nickel) is an element effective for increasing the hardenability of steel and increasing the strength of steel. The Ni content may be 0%, but may be included in accordance with need so as to obtain the above effect. The Ni content may be 0.01% or more, 0.10% or more, 0.20% or more, 0.50% or more, or 0.80% or more. On the other hand, excessive increase of Ni invites a rise in costs. Therefore, the Ni content is preferably 2.00% or less and may also be 1.80% or less or 1.50% or less.

(Cu: 0 to 2.00%)

Cu (copper) is an element effective for increasing the hardenability of steel and increasing the strength of steel. The Cu content may be 0%, but may be included in accordance with need so as to obtain the above effect. The Cu content may be 0.001% or more, 0.005% or more, or 0.01% or more. On the other hand, from the viewpoint of suppressing a drop in toughness, cracking of slabs after casting, and a drop in weldability, the Cu content is preferably 2.00% or less and may be 1.80% or less, 1.50% or less, or 1.00% or less.

(Mo: 0 to 1.00%)

Mo (molybdenum) is an element effective for increasing the hardenability of steel and increasing the strength of steel. The Mo content may be 0%, but may be included in accordance with need so as to obtain the above effect. The Mo content may be 0.01% or more, 0.10% or more, 0.20% or more, or 0.30% or more. On the other hand, from the viewpoint of suppressing a drop in toughness and weldability, the Mo content is preferably 1.00% or less and may also be 0.90% or less or 0.80% or less.

(W: 0 to 1.00%)

W (tungsten) is an element effective for increasing the hardenability of steel and increasing the strength of steel. The W content may be 0%, but may be included in accordance with need so as to obtain the above effect. The W content may be 0.001% or more, 0.005% or more, or 0.01% or more. On the other hand, from the viewpoint of suppressing a drop in toughness and weldability, the W content is preferably 1.00% or less and may also be 0.90% or less, 0.80% or less, 0.50% or less, or 0.10% or less.

(Ca: 0 to 0.100%)

Ca (calcium) is an element contributing to inclusion control, particularly fine dispersion of inclusions, and has the action of increasing toughness. The Ca content may be 0%, but may be included in accordance with need so as to obtain the above effect. The Ca content may also be 0.0001% or more, 0.0005% or more, or 0.001% or more. On the other hand, if excessively containing Ca, degradation of the surface properties will sometimes appear. For this reason, the Ca content is preferably 0.100% or less and may be 0.080% or less, 0.050% or less, 0.010% or less, or 0.005% or less.

(Mg: 0 to 0.100%)

Mg (magnesium) is an element contributing to inclusion control, particularly fine dispersion of inclusions, and has the action of increasing toughness. The Mg content may be 0%, but may be included in accordance with need so as to obtain the above effect. The Mg content may also be 0.0001% or more, 0.0005% or more, or 0.001% or more. On the other hand, if excessively containing Mg, degradation of the surface properties will sometimes appear. For this reason, the Mg content is preferably 0.100% or less and may also be 0.090% or less, 0.080% or less, 0.050% or less, or 0.010% or less.

(Zr: 0 to 0.100%)

Zr (zirconium) is an element contributing to inclusion control, particularly fine dispersion of inclusions, and has the action of increasing toughness. The Zr content may be 0%, but may be included in accordance with need so as to obtain the above effect. The Zr content may also be 0.001% or more, 0.005% or more, or 0.010% or more. On the other hand, if excessively containing Zr, degradation of the surface properties will sometimes appear. For this reason, the Zr content is preferably 0.100% or less and may be 0.050% or less, 0.040% or less, or 0.030% or less.

(Hf: 0 to 0.100%)

Hf (hafnium) is an element contributing to inclusion control, particularly fine dispersion of inclusions, and has the action of increasing toughness. The Hf content may be 0%, but may be included in accordance with need so as to obtain the above effect. The Hf content may also be 0.0001% or more, 0.0005% or more, or 0.001% or more. On the other hand, if excessively containing Hf, degradation of the surface properties will sometimes appear. Therefore, the Hf content is preferably 0.100% or less and may be 0.050% or less, 0.030% or less, or 0.010% or less.

(REM: 0 to 0.100%)

A REM (rare earth element) is an element contributing to inclusion control, particularly fine dispersion of inclusions, and has the action of increasing toughness. The REM content may be 0%, but may be included in accordance with need so as to obtain the above effect. The REM content may also be 0.0001% or more, 0.0005% or more, or 0.001% or more. On the other hand, if excessively containing REM, degradation of the surface properties will sometimes appear. For this reason, the REM content is preferably 0.100% or less and may also be 0.050% or less, 0.030% or less, or 0.010% or less. REM is an acronym for rare earth metals and indicates elements belonging to the lanthanide series. A REM is normally added as mischmetal.

In the steel sheet according to the present invention, the balance excluding the above chemical composition is comprised of Fe and impurities. Here, "impurities" mean constituents, etc., which enter from the ore, scraps, and other raw materials and various factors in the manufacturing process when industrially producing steel sheet.

In the present invention, the chemical composition of the steel sheet may be analyzed using an elemental analysis technique known to persons skilled in the art. For example, it is performed by inductively coupled plasma-mass spectroscopy (ICP-MS). However, C and S may be measured by combustion-infrared absorption, and N may be measured using inert gas fusion-thermal conductivity. These analyses may be performed on samples taken from the steel sheet by a method based on JIS G0417: 1999.

[Surface Layer]

In the present invention, the "surface layer" of the steel sheet means a region from the surface of the steel sheet (in the case of a plated steel sheet, the interface between the steel sheet and plating layer) to a predetermined depth in the thickness direction. The "predetermined depth" is typically 50 μm or less.

As illustrated in FIG. 2, the steel sheet 11 according to the present invention includes granular oxides 12 in the surface layer of the steel sheet 11. Preferably, the granular oxides 12 are present only in the surface layer of the steel sheet 11. By the granular oxides 12 being present inside of the base steel 14 (i.e., being present as internal oxides), it is possible for the steel sheet 11 to have high plateability compared to the case in which there is an external oxidation layer 2 on the surface of the base steel 3 shown in FIG. 1. This is believed to be a result of the fact that, in relation to the formation of the internal oxides, there is no external oxidation layer present impeding interdiffusion of the plating constituents and steel constituents when forming plating (for example, Zn-based plating) on the surface of steel sheet or it is only present in a sufficiently thin thickness, so the plating constituents and steel constituents are sufficiently interdiffused. Accordingly, the steel sheet and plated steel sheet according to the present invention which include granular oxides in the surface layer of the steel sheet, i.e., inside of the steel sheet, have high plateability.

Furthermore, as illustrated in FIG. 2, the steel sheet 11 according to the present invention may also include in the surface layer of the steel sheet 11 optionally grain boundary oxides 13 in addition to the granular oxides 12. The grain boundary oxides 13 are present at the inside of the base steel 14 in the same way as the granular oxides 12, so steel sheet and plated steel sheet containing both granular oxides 12 and grain boundary oxides 13 also have high plateability.

[Granular Oxides]

In the present invention, "granular oxides" mean oxides dispersed as grains inside the crystal grains of the steel or on the crystal grain boundaries. Furthermore, "granular" means being present away from each other mutually in the steel matrix, having, for example, a 1.0 to 5.0 aspect ratio (maximum linear length (major diameter) traversing the granular oxide/maximum linear length (minor diameter) traversing the oxide perpendicular to the major diameter). "Dispersed as grains" means that the grains of oxides are not positioned according to a specific rule (for example, linearly) but are positioned randomly. Since granular oxides are in fact typically present three-dimensionally in spherical shapes or substantially spherical shapes in the surface layer of the steel sheet, the granular oxides are typically observed to have circular shapes or substantially circular shapes when a cross-section of the surface layer of the steel sheet is observed. In FIG. 2, as an example, granular oxides 12 appearing to be substantially circular are shown.

(Average Grain Size)

In the present invention, the average grain size of the granular oxides is 300 nm or less. By controlling the average grain size to such a range, it is possible to make granular oxides finely disperse at the surface layer of the steel sheet. The granular oxides function well as trap sites for hydrogen suppressing the penetration of hydrogen in a corrosive environment and/or at the time of annealing in the production process and further function well as trap sites for Zn able to penetrate plated steel sheet comprised of steel sheet on which a plating layer is formed at the time of hot stamping or welding. On the other hand, if the average grain size is too large, the granular oxides will not sufficiently function as trap sites for hydrogen and/or trap sites for Zn and excellent hydrogen embrittlement resistance and/or LME resistance is liable to not be obtained. The average grain size of the granular oxides is preferably 250 nm or less, more preferably 200 nm or less, further preferably 150 nm or less. The finer the granular oxides, the better, so the average grain size of the granular oxides is not particularly prescribed in lower limit, but for example is 5 nm or more, 10 nm or more, or 50 nm or more.

(Number Density)

In the present invention, the number density of granular oxides is $4.0/\mu m^2$ or more. By controlling the number density to such a range, it is possible to make granular oxides finely disperse at the surface layer of the steel sheet. The granular oxides function well as trap sites for hydrogen suppressing the penetration of hydrogen in a corrosive environment and/or at the time of annealing in the production process and further function well as trap sites for Zn able to penetrate plated steel sheet obtained by forming a plating layer on steel sheet at the time of hot stamping or welding. On the other hand, if the number density is less than $4.0/\mu m^2$, the number density as trap sites for hydrogen and/or trap sites for Zn is not sufficient, the granular oxides do not sufficiently function as trap sites for hydrogen and/or trap sites for Zn, and good hydrogen embrittlement resistance and/or LME resistance is liable to be unable to be obtained. The number density of granular oxides is preferably $6.0/\mu m^2$ or more, more preferably $8.0/\mu m^2$ or more, further preferably $10.0/\mu m^2$ or more. The larger the amount of granular oxides present, the better, so while the number density of granular oxides is not particularly set in upper limit, it may for example be 100.0 $\mu m^2$ or less.

The average grain size and number density of the fine granular oxides are measured by a scan electron microscope (SEM). The specific measurement is as follows: A cross-section of the surface layer of the steel sheet is examined by a SEM and a SEM image including the granular oxides is obtained. From the SEM image, as examined regions, a total of 10 regions of 1.0 μm (depth direction)×1.0 μm (width direction) are selected. The examined position of each region is made 1.0 μm in the region from the steel sheet surface to 1.5 μm for the depth direction (direction vertical to surface of steel sheet) and is made 1.0 μm at any position of the SEM image for the width direction (direction parallel to surface of steel sheet). Next, SEM images of the regions selected in the above way are extracted and digitalized to divide them into oxide parts and steel parts. From the digitalized images, the area of each granular oxide part is calculated. Further, the number of granular oxides in each digitalized image is counted. From the total area and number of granular oxides of the total of regions in the 10 locations found in this way, the average grain size (nm) of the granular oxides is found as the circle equivalent diameter. Further, the number density of granular oxides ($/\mu m^2$) is equal to the average value of the numbers of granular oxides counted from the digitalized images. If only parts of the granular oxides are observed in the examined regions, i.e., if not all of the contours of the granular oxides are inside the examined regions, they are not counted in the numbers. Further, from the viewpoint of the measurement precision, the lower limit counted as the number of granular oxides is 5.0 nm is more.

[Grain Boundary Oxides]

Figure 3:
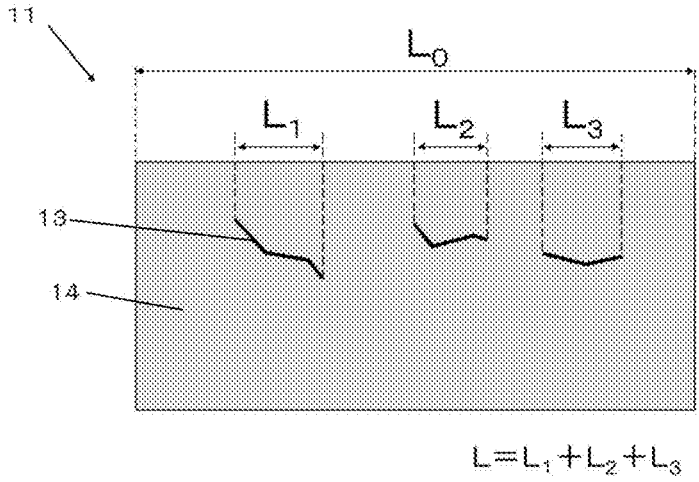
FIG. 3 is a schematic view for explaining measurement of the Ratio A of the steel sheet in FIG. 2.

The steel sheet according to the present invention may further contain grain boundary oxides at the surface layer of the steel sheet. In the present invention, "grain boundary oxides" means oxides present along the crystal grain boundaries of the steel. Oxides present inside the crystal grains of the steel are not included. In actuality, the grain boundary oxides are present in planar shapes so as to run along the crystal grain boundaries at the surface layer of the steel sheet, so when examining a cross-section of the surface layer of a steel sheet, such grain boundary oxides are observed in line shapes. In FIG. 2 and FIG. 3, as examples, grain boundary oxides 13 appearing as line shapes are shown. Further, in FIG. 2 and FIG. 3, as a typical example of the steel sheet 11, grain boundary oxides 13 are shown below the granular oxides 12, but sometimes grain boundary oxides are formed near the surface of the base steel 14.

(Ratio A)

Figure 4:
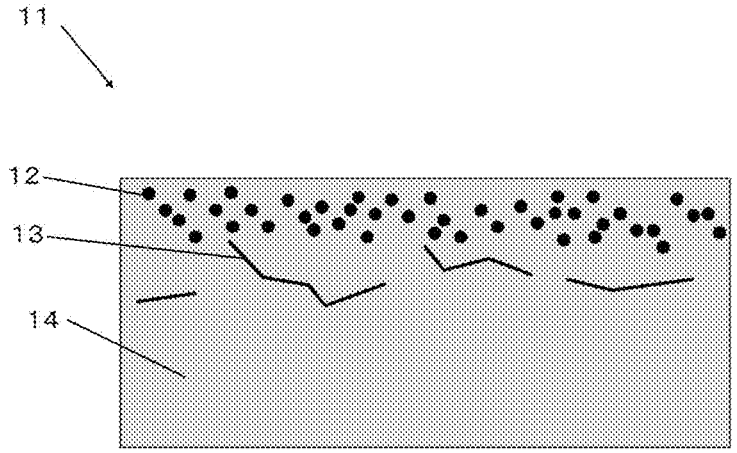
FIG. 4 is a schematic view of a cross-section of the steel sheet according to another embodiment of the present invention.
Figure 5:
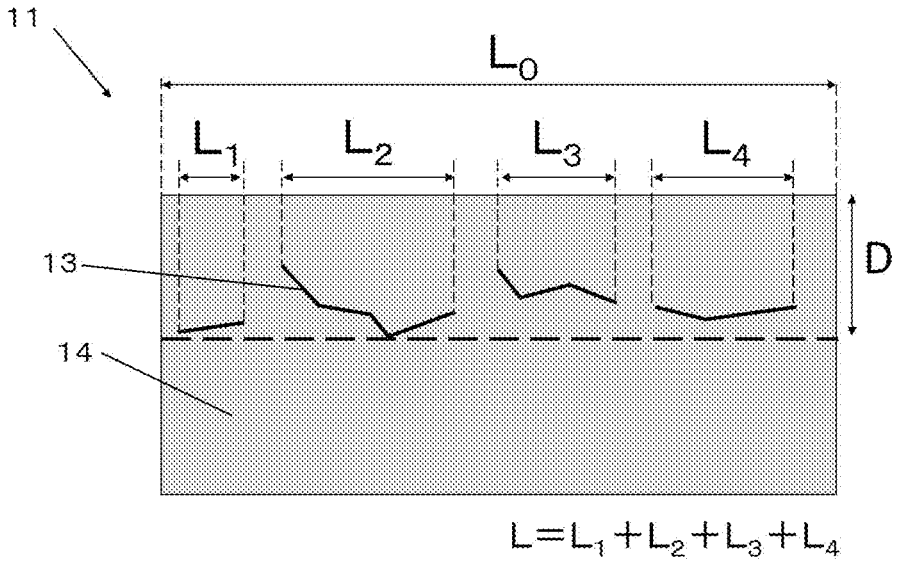
FIG. 5 is a schematic view for explaining measurement of the Ratio A of the steel sheet in FIG. 4.

If examining the cross-section of the surface layer of the steel sheet, the Ratio A of the length of the grain boundary oxides projected on the surface of the steel sheet with respect to the length of the surface of the steel sheet may be any value of 0 to 100%. In the present invention, the "Ratio A", as shown in FIGS. 3 and 5, means the ratio of the "length L ($=L_1+L_2+L_3+L_4$) of grain boundary oxides projected on the surface of the steel sheet to the length $L_0$ of the surface of the steel sheet" at the examined image in the case of examining the cross-section of the surface layer of the steel sheet 11. In one embodiment of the present invention, the Ratio A is 0% or more and less than 50%. In the steel sheet according to the present invention, the surface layer of the steel sheet need not contain grain boundary oxides, so the Ratio A may also be 0%. The Ratio A may for example be 1% or more. 3% or more, or 5% or more. Under production conditions where grain boundary oxides are formed in a relatively large amount, the average grain size of the granular oxides tends to become greater. Therefore, from the viewpoint of making the average grain size of the granular oxides finer, the Ratio A is, for example, preferably less than 50% such as shown in FIGS. 2 and 3 and may also be 40% or less. 30% or less. 20% or less. 10% or less, or 0%. In another embodiment of the present invention, the Ratio A is 50% or more. By controlling the Ratio A to such a range, it is possible to establish the presence of a large amount of grain boundary oxides at the surface layer of the steel sheet and make the grain boundary oxides function well as escape routes of hydrogen penetrating into the steel. For this reason, by establishing the presence of a relatively large amount of grain boundary oxides in addition to the Si—Mn depleted layer, it becomes possible to further improve the hydrogen dischargeability of the steel sheet according to the present invention. Therefore, from the viewpoint of better improving the discharge of hydrogen from the steel sheet, the Ratio A is for example, as shown in FIGS. 4 and 5, preferably 50% or more and may be 60% or more. 70% or more. 80% or more. 90% or more, or 100%.

The Ratio A, as shown in FIGS. 3 and 5, is determined by examining the cross-section of the surface layer of the steel sheet 11. The specific measurement method is as follows: The cross-section of the surface layer of the steel sheet 11 is examined by a SEM. The observed position is made a randomly selected location. From the observed SEM image, the length $L_0$ of the surface (i.e., the width of the SEM image) is measured. The length $L_0$ is made 100 μm or more (for example, 100 μm. 150 μm, or 200 μm) while the depth measured is made the region from the surface of the steel sheet down to 50 μm. Next, the position of the grain boundary oxides 13 from the SEM image is identified, the identified grain boundary oxides 13 are projected on the surface of the steel sheet 11 (in the case of a plated steel sheet, on the interface of the steel sheet 11 and plating layer), and the length L of the grain boundary oxides 13 in the field ($=L_1+L_2+L_3+L_4$) is found. Based on the thus found $L_0$ and L, the ratio A (%) in the present invention$=100\times L/L_0$ is found. FIGS. 3 and 5 are views eliminating the granular oxides 12 for explanation.

[Chemical Composition of Oxides]

In the present invention, the granular oxides and optional grain boundary oxides (below, also referred to simply as "oxides") include one or more of the above-mentioned elements included in the steel sheet in addition to oxygen and typically have chemical compositions including Si, O, and Fe and in some cases further including Mn. More specifically, the oxides typically contain Si: 5 to 25%, Mn: 0 to 10%, O: 40 to 65%, and Fe: 10 to 30%. The oxides may also contain elements able to be included in the above-mentioned steel sheet (for example, Cr, etc.) in addition to these elements.

[Si—Mn Depleted Layer]

The steel sheet according to the present invention contains an Si—Mn depleted layer having a thickness of 3.0 μm or more from the surface of the steel sheet. The contents of Si and Mn of the Si—Mn depleted layer not containing oxides at the ½ position of that thickness are respectively less than 10% of the contents of Si and Mn at the sheet thickness center part of the steel sheet. By making the Si—Mn depleted layer formed at the surface layer of the steel sheet due to the formation of the granular oxides and optional grain boundary oxides a thickness of 3.0 μm or more and controlling the Si and Mn depletion rates of the Si—Mn depleted layer respectively less than 10%, it is possible to sufficiently reduce the amounts of dissolved Si and Mn impeding diffusion of hydrogen. As a result, it becomes possible to promote diffusion of hydrogen and remarkably improve the dischargeability of hydrogen from inside the steel. By making the thickness of the Si—Mn depleted layer greater, it is possible to promote more the diffusion of hydrogen from inside the steel, so the thickness of the Si—Mn depleted layer is preferably 4.0 μm or more, more preferably 5.0 μm or more, most preferably 7.0 μm or more. The upper limit of thickness of the Si—Mn depleted layer is not particularly limited, but for example the thickness of the Si—Mn depleted layer may be 50.0 μm or less.

Similarly, by making the Si and Mn depletion rates of the Si—Mn depleted layer smaller, it is possible to further reduce the amounts of dissolved Si and Mn in the steel. For this reason, the Si depletion rate of the Si—Mn depleted layer is preferably 8% or less, more preferably 6% or less, most preferably 4% or less. The lower limit of the Si depletion rate is not particularly prescribed, but may be 0%. Similarly, the Mn depletion rate of the Si—Mn depleted layer is preferably 8% or less, more preferably 6% or less, most preferably 4% or less. The lower limit of the Mn depletion rate is not particularly prescribed, but may be 0%. In the present invention, the expression "not containing oxides" means not containing not only the above granular oxides and grain boundary oxides, but also any other oxides. Such a region not containing oxides can be identified by examination of the cross-section by a SEM and energy dispersed X-ray spectroscopy (EDS). Further, the Si—Mn depleted layer according to the present invention cannot be controlled to the desired ranges of thickness and composition just by forming granular oxides and other internal oxides. As explained in detail later, it becomes important to suitably control the progression of internal oxidation in the production process.

The thickness of the Si—Mn depleted layer, as shown by D in FIG. 5, means the distance from the surface of the steel sheet 11 to the furthest position where an internal oxide (in FIG. 5, grain boundary oxide 13) is present when proceeding from the surface of the steel sheet 11 (in the case of a plated steel sheet, the interface of the steel sheet and plating layer) in the thickness direction of the steel sheet 11 (direction vertical to surface of steel sheet). If no grain boundary oxides exist, the thickness of the Si—Mn depleted layer means the distance from the surface of the steel sheet to the furthest position where a granular oxide is present when proceeding from the surface of the steel sheet (in the case of a plated steel sheet, the interface of the steel sheet and plating layer) in the thickness direction of the steel sheet 11 (direction vertical to surface of steel sheet). The thickness of the Si—Mn depleted layer may be found from the same image as the SEM image used for measuring the above-mentioned Ratio A (length $L_0$ of surface). Further, the Si and Mn contents of the region not containing oxides at the ½ position of thickness of the Si—Mn depleted layer are determined by analyzing points of 10 locations not containing oxides randomly selected at ½ position of thickness of the Si—Mn depleted layer determined from the SEM image by a transmission electron microscope with an energy dispersed X-ray spectroscope (TEM-EDS) and obtaining the arithmetic averages of the obtained measured values of the Si and Mn concentrations. Further, the Si and Mn contents at the sheet thickness center part of the steel sheet are determined by examining the cross-section of the sheet thickness center part by a SEM, analyzing points of 10 locations randomly selected at the sheet thickness center part from the SEM image by a transmission electron microscope with an energy dispersed X-ray spectroscope (TEM-EDS), and obtaining the arithmetic averages of the obtained measured values of the Si and Mn concentrations. Finally, the values of the Si and Mn contents at the ½ position of thickness of the Si—Mn depleted layer divided by the Si and Mn contents at the sheet thickness center part of the steel sheet and expressed as percentages are determined as the Si and Mn depletion rates.

<Plated Steel Sheet>

The plated steel sheet according to the present invention has a plating layer containing Zn on the above-mentioned steel sheet according to the present invention. This plating layer may be formed on one side of the steel sheet or may be formed on both sides. As the plating layer containing Zn, for example, a hot dip galvanized layer, hot dip galvannealed layer, electrogalvanized layer, electrogalvannealed layer, etc., may be mentioned. More specifically, as the plating type, for example, Zn-0.2% Al (GI), Zn-(0.3 to 1.5)% Al, Zn-4.5% Al, Zn-0.09% Al-10% Fe (GA), Zn-1.5% Al-1.5% Mg, Zn-11% Al-3% Mg-0.2% Si, Zn-11% Ni, Zn-15% Mg, etc., can be used.

[Chemical Composition of Plating Layer]

The chemical composition included in a plating layer containing Zn in the present invention will be explained next. The "%" regarding content of the elements, unless otherwise stated, will mean "mass %". In the numerical ranges in the chemical composition of the plating layer, a numerical range expressed using "to", unless otherwise indicated, will mean a range having the numerical values before and after the "to" as the lower limit value and the upper limit value.

(Al: 0 to 60.0%)

Al is an element which is included together with Zn or is alloyed with it and improves the corrosion resistance of the plating layer, so may be included in accordance with need. Therefore, the Al content may be 0%. To form a plating layer containing Zn and Al, preferably the Al content is 0.01% or more. For example, it may be 0.1% or more, 0.5% or more, 1.0% or more, or 3.0% or more. On the other hand, even if excessively containing Al, the effect of improvement of the corrosion resistance becomes saturated, so the Al content is preferably 60.0% or less. For example, it may be 55.0% or less, 50.0% or less, 40.0% or less, 30.0% or less, 20.0% or less, 10.0% or less, or 5.0% or less. From the viewpoint of improvement of the LME resistance, the Al is preferably 0.4 to 1.5%.

(Mg: 0 to 15.0%)

Mg is an element which is included together with Zn and Al or is alloyed with the same and improves the corrosion resistance of the plating layer, so may be included in accordance with need. Therefore, the Mg content may be 0%. To form a plating layer containing Zn, Al, and Mg, preferably the Mg content is 0.01% or more. For example, it may be 0.1% or more, 0.5% or more, 1.0% or more, or 3.0% or more. On the other hand, if excessively containing Mg, the Mg will not completely dissolve in the plating bath but will float as oxides. If galvanizing by such a plating bath, oxides will deposit on the surface layer causing poor appearance or liable to cause the occurrence of non-plated parts. For this reason, the Mg content is preferably 15.0% or less, for example, may be 10.0% or less or 5.0% or less.

(Fe: 0 to 15.0%)

Fe can be included in the plating layer due to diffusion from the steel sheet when forming a plating layer containing Zn on the steel sheet, then heat treating the plated steel sheet. Therefore, Fe is not included in the plating layer in a state not treated by heat, so the Fe content may also be 0%. Further, the Fe content may be 1.0% or more, 2.0% or more, 3.0% or more, 4.0% or more, or 5.0% or more. On the other hand, the Fe content is preferably 15.0% or less, for example, may be 12.0% or less, 10.0% or less, 8.0% or less, or 6.0% or less.

(Si: 0 to 3.0%)

Si is an element which further improves the corrosion resistance if included in a plating layer containing Zn, in particular a Zn—Al—Mg plating layer, so may be included in accordance with need. Therefore, the Si content may be 0%. From the viewpoint of improvement of the corrosion resistance, the Si content may for example be 0.005% or more, 0.01% or more, 0.05% or more, 0.1% or more, or 0.5% or more. Further, the Si content may be 3.0% or less, 2.5% or less, 2.0% or less, 1.5% or less, or 1.2% or less.

The basic chemical composition of the plating layer is as explained above. Furthermore the plating layer may contain, optionally, one or more of Sb: 0 to 0.50%, Pb: 0 to 0.50%, Cu: 0 to 1.00%, Sn: 0 to 1.00%, Ti: 0 to 1.00%, Sr: 0 to 0.50%, Cr: 0 to 1.00%, Ni: 0 to 1.00%, and Mn: 0 to 1.00%. While not particularly limited, from the viewpoint of sufficiently manifesting the actions and functions of the basic constituents forming the plating layer, the total content of these optional elements is preferably made 5.00% or less, more preferably 2.00% or less.

At the plating layer, the balance besides the above constituents is comprised of Zn and impurities. The "impurities at the plating layer" mean constituents such as the raw material entering due to various factors in the production process when producing the plating layer. In the plating layer, as impurities, elements besides the basic constituents and optional constituents explained above may be included in trace amounts in a range not impeding the effect of the present invention.

The chemical composition of the plating layer can be determined by dissolving the plating layer in an acid solution containing an inhibitor for inhibiting corrosion of the steel sheet and measuring the obtained solution by ICP (inductively coupled plasma) emission spectroscopy.

The thickness of the plating layer may for example be 3 to 50 μm. Further, the amount of deposition of the plating layer is not particularly limited but for example may be 10 to 170 g/m$^2$ per side. In the present invention, the amount of deposition of the plating layer is determined by dissolving the plating layer in an acid solution containing an inhibitor for inhibiting corrosion of the base iron and finding the change in weight before and after pickling.

[Tensile Strength]

The steel sheet and plated steel sheet according to the present invention preferably have a high strength. Specifically, they preferably have 440 MPa or more tensile strength. For example, the tensile strength may be 500 MPa or more, 600 MPa or more, 700 MPa or more, or 800 MPa or more. The upper limit of the tensile strength is not particularly prescribed, but from the viewpoint of securing toughness, may for example be 2000 MPa or less. The tensile strength may be measured by taking a JIS No. 5 tensile test piece having a direction vertical to the rolling direction as its longitudinal direction and performing a test based on JIS Z 2241(2011).

The steel sheet and plated steel sheet according to the present invention are high in strength and have a high plateability, LME resistance, and hydrogen embrittlement resistance, so can be suitably used in a broad range of fields such as automobiles, household electric appliances, and building materials, but are particularly preferably used in the automotive field. Steel sheet used for automobiles usually is plated (typically Zn-based plating), so if using the steel sheet according to the present invention as steel sheet for automobiles, the effect of the present invention of having a high plateability is optimally exhibited. Further, steel sheet and plated steel sheet used for automobiles are often hot stamped. In that case, hydrogen embrittlement cracking and LME cracking can become remarkable problems. Therefore, when using the steel sheet and plated steel sheet according to the present invention as steel sheet for automobiles, the effect of the present invention of having a high hydrogen embrittlement resistance and LME resistance is optimally exhibited.

<Method of Production of Steel Sheet>

Below, a preferable method of production of the steel sheet according to the present invention will be explained. The following explanation is intended to illustrate the characteristic method for producing the steel sheet according to the present invention and is not intended to limit the steel sheet to one produced by the method of production explained below.

The steel sheet according to the present invention can be obtained for example by performing a casting step of casting molten steel adjusted in chemical composition to form a steel slab, a hot rolling step of hot rolling the steel slab to obtain hot rolled steel sheet, a coiling step of coiling the hot rolled steel sheet, a cold rolling step of cold rolling the coiled hot rolled steel sheet to obtain cold rolled steel sheet, a grinding step of introducing dislocations into the surface of the cold rolled steel sheet, and an annealing step of annealing the ground cold rolled steel sheet. Alternatively, the hot rolled steel sheet may not be coiled after the hot rolling step, but pickled and then cold rolled as it is.

[Casting Step]

The conditions of the casting step are not particularly prescribed. For example, after smelting by a blast furnace or electric furnace, etc., various secondary refining operations may be performed, then the molten metal cast by the usual continuous casting, ingot casting, or other method.

[Hot Rolling Step]

The thus cast steel slab can be hot rolled to obtain hot rolled steel sheet. The hot rolling step is performed by directly hot rolling the cast steel slab or by reheating after cooling once. If reheating, the heating temperature of the steel slab may for example be 1100° C., to 1250° C. In the hot rolling step, usually rough rolling and finish rolling are performed. The temperatures and rolling reductions of the rolling operations may be suitably changed in accordance with the desired metallographic structure and sheet thickness. For example, the end temperature of the finish rolling may be made 900 to 1050° C., and the rolling reduction of the finish rolling may be made 10 to 50%.

[Coiling Step]

The hot rolled steel sheet can be coiled at a predetermined temperature. The coiling temperature may be suitably changed in accordance with the desired metallographic structure, etc., and may for example be 500 to 800° C. The hot rolled steel sheet may be heat treated under predetermined conditions before being coiled or after being coiled by being uncoiled. Alternatively, the sheet can be pickled after the hot rolling step without performing a coiling step and then subjected to a later explained cold rolling step.

[Cold Rolling Step]

After pickling the hot rolled steel sheet, the hot rolled steel sheet can be cold rolled to obtain cold rolled steel sheet. The rolling reduction of the cold rolling may be suitably changed in accordance with the desired metallographic structure and sheet thickness and may for example be 20 to 80%. After the cold rolling step, for example, the sheet may be air cooled to cool it down to room temperature.

[Grinding Step]

To obtain granular oxides in a fine size and large amount and further the optional grain boundary oxides in the desired amount at the surface layer of the finally obtained steel sheet and to cause the formation of an Si—Mn depleted layer having the desired thickness and composition, it is effective to perform a grinding step before annealing the cold rolled steel sheet. Due to that grinding step, it is possible to introduce a large amount of dislocations to the surface of the cold rolled steel sheet. Oxygen, etc., diffuse faster at the grain boundaries than inside the grains, so by introducing a large amount of dislocations to the surface of the cold rolled steel sheet, it is possible to form a large number of paths in the same way as the case of grain boundaries. For this reason, at the time of annealing, oxygen easily diffuses (penetrates) to the inside of the steel along these dislocations and the speeds of diffusion of Si and Mn are also improved, so as a result, the oxygen bonds with the Si and/or Mn inside of the steel and formation of granular oxides and further the optional grain boundary oxides can be promoted. Further, along with promotion of formation of these internal oxides, the drop in the concentrations of Si and Mn in the surroundings is also promoted, so it is also possible to promote the formation of an Si—Mn depleted layer having the desired thickness and composition. The grinding step is not particularly limited, but for example can be performed by using a heavy duty grinding brush to grind the surface of cold rolled steel sheet under conditions of an amount of grinding of 10 to 200 g/m$^2$. The amount of grinding by the heavy duty grinding brush can be adjusted by any suitable method known to persons skilled in the art. While not particularly limited, for example, it can be adjusted by suitably selecting the number, speed, brushing pressure, coating solution used, etc., of the heavy duty grinding brush. By performing such a grinding step, in the later explained annealing step, it becomes possible to form the desired granular oxides and optional grain boundary oxides and possible to reliably and efficiently form an Si—Mn depleted layer having the desired thickness and composition, i.e., having a 3.0 μm or more thickness and having Si and Mn depletion rates of respectively less than 10%, at the surface layer of the steel sheet.

[Annealing Step]

The cold rolled steel sheet subjected to the above grinding step is annealed. The annealing is preferably performed in a state in which tension is applied to the cold rolled steel sheet in the rolling direction. In particular, in a region where the annealing temperature is 500° C., or more, it is preferable to raise the tension in performing the annealing compared with other regions. Specifically, in a region where the annealing temperature is 500° C., or more, it is preferable to perform the annealing in a state applying 3 to 150 MPa, in particular 15 to 150 MPa of tension to the cold rolled steel sheet in the rolling direction. If applying tension at the time of annealing, a large amount of dislocations can be more effectively introduced to the surface of the cold rolled steel sheet. Therefore, at the time of annealing, it is made easier for oxygen to diffuse to (penetrate) the inside of the steel along those dislocations and the speeds of diffusion of Si and Mn are also improved, so oxides become easier to form inside the steel sheet. As a result, this is advantageous for increase of the number density of the granular oxides, formation of the desired ratio of the grain boundary oxides, and formation of the Si—Mn depleted layer having the desired thickness and composition.

The holding temperature at the annealing step is preferably 700° C., to 870° C. From the viewpoint of making the granular oxides form in a fine size and large amount while keeping down the formation of the grain boundary oxides to within a range of a Ratio A of less than 50%, the holding temperature at the annealing step is preferably 700° C., to 780° C., more preferably 720 to 760° C. If the holding temperature of the annealing step is less than 700° C., granular oxides are liable to not be sufficiently formed and sometimes the hydrogen penetration resistance will become insufficient. On the other hand, from the viewpoint of causing the formation of a large amount of grain boundary oxides so that the granular oxides become fine in size and large in amount and the Ratio A becomes 50% or more, the holding temperature of the annealing step is preferably more than 780° C., to 870° C., more preferably 800 to 850° C. On the other hand, if the holding temperature of the annealing step is more than 870° C., granular oxides are liable to not be sufficiently formed and sometimes the hydrogen penetration resistance and in turn the hydrogen embrittlement resistance will become insufficient and further the LME resistance will become insufficient. Further, if the holding temperature of the annealing step is more than 900° C., an external oxidation layer will formed at the surface of the steel sheet and the plateability is liable to become insufficient. The temperature elevation rate up to the holding temperature is not particularly limited, but may be 1 to 10° C./s. Further, the temperature elevation may be performed in two stages by a first temperature elevation rate of 1 to 10° C./s and a second temperature elevation rate of 1 to 10° C./s different from the first temperature elevation rate.

The holding time at the holding temperature of the annealing step is preferably more than 50 seconds to 150 seconds, more preferably 80 to 120 seconds. If the holding time is 50 seconds or less, the granular oxides and optional grain boundary oxides are liable to not be sufficiently formed and sometimes the hydrogen embrittlement resistance and LME resistance will become insufficient. On the other hand, if the holding time is more than 150 seconds, the granular oxides are liable to become coarser and sometimes the hydrogen embrittlement resistance and LME resistance will become insufficient.

From the viewpoint of causing the formation of granular oxides in a fine size and large amount, the dew point of the atmosphere in the annealing step is preferably −20 to 10° C., more preferably −10 to 5° C. If the dew point is too low; an external oxidation layer is liable to be formed on the surface of the steel sheet and internal oxides liable to not be sufficiently formed. The plateability, hydrogen embrittlement resistance, and LME resistance will sometimes become insufficient. On the other hand, by raising the dew point, it is possible to promote the formation of grain boundary oxides, but if the dew point is too high, Fe oxides will form as external oxides on the steel sheet surface and sometimes the plateability will become insufficient. Further, sometimes the granular oxides will coarsened and the hydrogen embrittlement resistance and/or LME resistance will become insufficient. Further, the atmosphere in the annealing step may be a reducing atmosphere, more specifically a reducing atmosphere containing nitrogen and hydrogen, for example, a reducing atmosphere of hydrogen in 1 to 10% (for example, hydrogen 4% and balance of nitrogen).

Furthermore, it is effective to remove the internal oxidation layer (typically including the grain boundary oxides) of the steel sheet when performing the annealing step. During the above-mentioned rolling step, in particular the hot rolling step, sometimes an internal oxidation layer is formed at the surface layer of the steel sheet. Such an internal oxidation layer formed in a rolling step is liable to inhibit the formation of granular oxides at the annealing step, so that internal oxidation layer is preferably removed before annealing by pickling, etc. More specifically, the depth of the internal oxidation layer of the cold rolled steel sheet when performing an annealing step may be 0.5 μm or less, preferably 0.3 μm or less, more preferably 0.2 μm or less, still more preferably 0.1 μm or less.

By performing the steps explained above, it is possible to obtain steel sheet comprised of steel sheet with a surface layer containing granular oxides in a sufficiently fine size and large amount and including an Si—Mn depleted layer having a desired thickness and composition.

If providing a step, as a stage before the annealing step, of oxidizing and then reducing the steel in the oxidation zone by a 0.9 to 1.4 air ratio or air-fuel ratio, in the oxidation step, the granular oxides will excessively grow beyond the average grain size 300 nm, so the granular oxides will not sufficiently function as trap sites for hydrogen and/or trap sizes for Zn and it will become difficult to obtain good hydrogen embrittlement resistance and/or LME resistance.

<Method of Production of Plated Steel Sheet>

Below, a preferable method of production of the plated steel sheet according to the present invention will be explained. The following explanation is intended to illustrate the characteristic method for producing the plated steel sheet according to the present invention and is not intended to limit the plated steel sheet to one produced by the method of production explained below.

The plated steel sheet according to the present invention can be obtained by performing a plating step for forming a plating layer containing Zn on the steel sheet produced in the above way.

[Plating Step]

The plating step may be performed according to a method known to persons skilled in the art. The plating step may for example be performed by hot dip coating and may be performed by electroplating. Preferably, the plating step is performed by hot dip coating. The conditions of the plating step may be suitably set considering the chemical composition, thickness, amount of deposition, etc., of the desired plating layer. After the plating, alloying may be performed. Typically, the conditions of the plating step may be set so as to form a plating layer containing Al: 0 to 60.0%, Mg: 0 to 15.0%, Fe: 0 to 15%, and Si: 0 to 3% and having a balance of Zn and impurities. More specifically, the conditions of the plating step may for example be suitably set so as to form for example Zn-0.2% Al (GI), Zn-0.09% Al (GA), Zn-1.5% Al-1.5% Mg, or Zn-11% Al-3% Mg-0.2% Si.

EXAMPLES

Below, examples will be used to explain the present invention in more detail, but the present invention is not limited to these examples in any way.

In the following examples, in Example X, steel sheets having a Ratio A relating to grain boundary oxides of 0% or more and less than 50% were produced, while in Example Y, steel sheets having a Ratio A relating to grain boundary oxides of 50% or more were produced. The steel sheets produced in the respective example were investigated for plateability, hydrogen embrittlement resistance, and LME resistance.

Example X (Preparation of Steel Sheet Samples)

Molten steels adjusted in chemical compositions were cast to form steel slabs. The steel slabs were hot rolled, pickled, then cold rolled to obtain cold rolled steel sheets. Next, the sheets were air-cooled down to room temperature. The cold rolled steel sheets were pickled, then the internal oxidation layers formed by rolling were removed down to the internal oxidation layer depth (μm) before annealing described in Table 1. Next, samples were taken from the cold rolled steel sheets by the method based on JIS G0417: 1999 and the chemical compositions of the steel sheets were analyzed by ICP-MS, etc. The measured chemical compositions of the steel sheets are shown in Table 1. The thicknesses of the steel sheets used were 1.6 mm in all cases.

Next, each of the cold rolled steel sheets was coated with an NaOH aqueous solution, then the surface of the cold rolled steel sheet was ground using a heavy duty grinding brush by an amount of 10 to 200 g/m$^2$ (Sample No. 135 no grinding). After that, each was annealed by the dew point, holding temperature, and holding time shown in Table 1 (mainly holding temperature of 700 to 780° C., and holding time of more than 50 seconds to 150 seconds) (annealing atmosphere: hydrogen 4% and balance of nitrogen) to prepare each steel sheet sample. In all of the steel sheet samples, the temperature elevation rate at the time of annealing was made 6.0° C./s up to 500° C., and was made 2.0° C./s from 500° C., to the holding temperature. In the above annealing, the cold rolled steel sheet was annealed in the state applying 1 MPa or more of tension in the rolling direction. In the region of an annealing temperature of 500° C., or more, compared with other regions, the annealing was performed in the state applying a higher tension in the rolling direction, specifically a tension of 3 to 150 MPa (in Sample No. 134, such tension not applied). The presence of any grinding by a heavy duty grinding brush and the conditions of the annealing (presence of application of tension of 3 to 150 MPa, dew point (° C.), holding temperature (° C.), and holding time (s) in region with annealing temperature of 500° C., or more) are shown in Table 1. In each steel sheet sample, a JIS No. 5 tensile test piece having a direction vertical to the rolling direction as its longitudinal direction was taken. A tensile test was performed based on JIS Z 2241(2011). As a result, in Nos. 116 and 118, the tension strengths were less than 440 MPa, while in the others, they were 440 MPa or more.

(Analysis of Surface Layer of Steel Sheet Samples)

Each steel sheet sample prepared in the above way was cut to 25 mm×15 mm. The cut sample was buried in a resin and polished to a mirror surface. At the cross-section of each steel sheet sample. 1.0 μm×1.0 μm regions were examined by a SEM at 10 locations. The examined positions were made the 1.0 μm from 0.2 to 1.2 μm from the steel sheet surface for the depth direction (direction vertical to surface of steel sheet) and 1.0 μm of any position of the SEM image for the width direction (direction parallel to surface of steel sheet). As the regions, regions not containing grain boundary oxides were selected. Next, the SEM images of the regions of the steel sheet samples obtained were digitalized, the areas of the granular oxide parts were calculated from the digitalized images, and further the numbers of the granular oxides in the SEM images were counted. From the areas and numbers of granular oxides at the 10 digitalized images found in this way, the average grain size as the circular equivalent diameter and number density of the granular oxides were found. The average grain size (nm) and number density (/μm$^2$) of the granular oxides of the steel sheet samples are shown in Table 1. In Table 1, if there are no granular oxides in the SEM image (case where number density=0), the average grain size was described as "-".

Further, the Ratio A for each steel sheet sample was measured from examination of the cross-section of the above buried sample. Specifically, in a 150 μm width (=$L_0$) SEM image, the positions of grain boundary oxides were identified, the identified grain boundary oxides were projected on the surface of the steel sheet, and the lengths L of the grain boundary oxides in the field were found. Based on the $L_0$ and L found in this way, the Ratio A (%)=100×L/$L_0$ was found. The ratio A (%) of granular oxides for each steel sheet sample is shown in Table 1.

The thickness of the Si—Mn depleted layer was determined in the SEM image for which the Ratio A was measured by measuring the distance from the surface of the steel sheet to the furthest position where grain boundary oxides (granular oxides if no grain boundary oxides present) are present when proceeding from the surface of the steel sheet in the thickness direction of the steel sheet (direction vertical to surface of steel sheet). Further, the Si and Mn contents of the region not containing oxides at the ½ position of thickness of the Si—Mn depleted layer are determined by analyzing points of 10 locations not containing oxides randomly selected at ½ position of thickness of the Si—Mn depleted layer determined from the SEM image by a TEM-EDS and obtaining the arithmetic averages of the obtained measured values of the Si and Mn concentrations. Further, the Si and Mn contents at the sheet thickness center part of the steel sheet are determined by examining the cross-section of the sheet thickness center part by a SEM, analyzing points of 10 locations randomly selected at the sheet thickness center part from the SEM image by a TEM-EDS, and obtaining the arithmetic averages of the obtained measured values of the Si and Mn concentrations. Finally, the values of the Si and Mn contents at the ½ position of thickness of the Si—Mn depleted layer divided by the Si and Mn contents at the sheet thickness center part of the steel sheet and expressed as percentages are determined as the Si and Mn depletion rates. Further, each steel sheet sample was analyzed for chemical compositions of the granular oxides and grain boundary oxides, whereupon each of the oxides contained Si, O. and Fe and numerous oxides further contained Mn. The chemical composition of each of the oxides also contained Si: 5 to 25%, Mn: 0 to 10%, O: 40 to 65%, and Fe: 10 to 30%.

(Preparation of Samples of Plated Steel Sheet)

Each of the samples of steel sheets of Example 1 was cut to 100 mm×200 mm size, then was plated for forming the plating type shown in Table 1 to thereby prepare a sample of the plated steel sheet. In Table 1, the plating type A means "hot dip galvannealed steel sheet (GA)", the plating type B means "hot dip galvanized-0.2% Al-plated steel sheet (GI)", and the plating type C means "hot dip galvanized-(0.3 to 1.5)% Al-plated steel sheet (Al content described in Table 1)". In the hot dip galvanization step, the cut sample was dipped in a 440° C., hot dip galvanization bath for 3 seconds. After dipping, it was pulled out at 100 mm/s. $N_2$ wiping gas was used to control the amount of plating deposition to 50 g/m$^2$. For the plating type A, alloying was performed after that at 460° C.

(Analysis of Composition of Plating Layer)

The composition of each plating layer was found by dipping a sample cut to 30 mm×30 mm in a 10% aqueous hydrochloric acid solution containing an inhibitor (Ibit made by Asahi Chemical), peeling off the plating layer by pickling, then analyzing the plating constituents dissolved in the aqueous solution by ICP.

(Evaluation of Plateability)

Each plated steel sheet sample was measured for area ratio of non-plated parts on the surface of that steel sheet so as to evaluate the plateability. Specifically, a 1 mm×1 mm region of the surface of each plated steel sheet sample formed with the plating layer was examined under an optical microscope, parts at which the plating layer was formed (plated parts) and parts where the plating layer was not formed (non-plated parts) were judged from the examined image, the area ratio of the non-plated parts (area of non-plated parts/area of observed image) was calculated, and the plateability was evaluated by the following criteria. The results are shown in Table 1. A is passing and B is failing.

Evaluation A: 5.0% or less

Evaluation B: more than 5.0%

(Evaluation of LME Resistance)

Each 100×100 mm plated steel sheet sample was spot welded and was cut to 50 mm×100 mm size to prepare two sheets. The two sheets of Zn-based plated steel sheet samples were spot welded using a dome radius type tip size 8 mm welding electrode at a weld angle of 7°, weld force of 3.0 kN, weld time 0.5 second, and weld current 7 kA to obtain a welded member. The welded part was polished at its cross-section, then examined under an optical microscope and measured for length of LME cracking occurring at the cross-section of the welded part and evaluated as follows. The results are shown in Table 1. AAA, AA, and A are passing and B is failing.

Evaluation AAA: LME crack length more than 0 μm to 150 μm

Evaluation AA: LME crack length more than 150 μm to 300 μm

Evaluation A: LME crack length more than 300 μm to 500 μm

Evaluation B: LME crack length more than 500 μm (Evaluation of Hydrogen Embrittlement Resistance)

Each 50 mm×100 mm plated steel sheet sample was treated to form zinc phosphate using a zinc phosphate-based conversion coating (Surfdine SD5350 series: made by Nippon Paint Industrial Coating), then was formed with an electrodeposition coating (PN110 Powermix Grey: made by Nippon Paint Industrial Coating) to 20 μm and was baked at a 150° C., baking temperature for 20 minutes to form a coating on the plated steel sheet sample. Next, the sample was used for a cyclic corrosion test according to JASO (M609-91). The amount of diffused hydrogen after the elapse of 120 cycles was measured by the thermal desorption method. Specifically, the plated steel sheet sample was heated to 400° C., in a heating furnace provided with a gas chromatography device. The sum of the amount of hydrogen discharged until falling to 250° C., was measured. Based on the measured amount of diffusible hydrogen, the hydrogen embrittlement resistance (amount of hydrogen built up in sample) was evaluated by the following criteria. The results are shown in Table 1. AA and A are passing and B is failing.

Evaluation AA: less than 0.3 ppm

Evaluation A: 0.5 to 0.3 ppm or less

Evaluation B: more than 0.5 ppm

TABLE 1

| | | Chemical composition (mass %) | | | | | | | | | Depth of internal oxidation layer before annealing | Grinding (heavy duty grinding |
|---|---|---|---|---|---|---|---|---|---|---|---|---|
| No. | Class | Fe | C | Si | Mn | Al | P | S | N | Others | (μm) | brush) |
| 101 | Comp. ex. | Bal | 0.05 | 1.6 | 2.0 | 0.0201 | 0.0090 | 0.0013 | 0.0024 | | 2.7 | Yes |
| 102 | Ex. | Bal. | 0.05 | 1.1 | 2.0 | 0.0152 | 0.0060 | 0.0150 | 0.0039 | REM: 0.004 | 0.1 | Yes |
| 103 | Ex. | Bal. | 0.05 | 2.0 | 2.0 | 0.1255 | 0.0120 | 0.0012 | 0.0021 | | 0.1 | Yes |
| 104 | Ex. | Bal. | 0.10 | 0.5 | 2.0 | 0.0122 | 0.0083 | 0.0025 | 0.0031 | Hf: 0.003 | 0.2 | Yes |
| 105 | Ex. | Bal | 0.10 | 1.5 | 2.0 | 0.0240 | 0.0120 | 0.0024 | 0.0024 | | 0.2 | Yes |
| 106 | Ex. | Bal. | 0.20 | 0.5 | 2.0 | 0.0212 | 0.0155 | 0.0020 | 0.0025 | Mg: 0.004 | 0.1 | Yes |
| 107 | Ex. | Bal | 0.20 | 1.0 | 2.0 | 0.0150 | 0.0152 | 0.0029 | 0.0011 | Zr: 0.040 | 0.1 | Yes |
| 108 | Ex. | Bal. | 0.20 | 1.8 | 2.2 | 0.0170 | 0.0244 | 0.0019 | 0.0021 | B: 0.001 | 0.2 | Yes |
| 109 | Comp. ex. | Bal. | 0.20 | 1.6 | 2.0 | 0.0200 | 0.0101 | 0.0017 | 0.0013 | | 0.1 | Yes |
| 110 | Comp. ex. | Bal. | 0.20 | 1.6 | 2.0 | 0.0320 | 0.0131 | 0.0015 | 0.0025 | | 0.1 | Yes |
| 111 | Comp. ex. | Bal. | 0.20 | 1.6 | 2.0 | 0.0040 | 0.0110 | 0.0025 | 0.0012 | | 0.3 | Yes |
| 112 | Comp. ex. | Bal. | 0.20 | 1.6 | 2.0 | 0.0070 | 0.0084 | 0.0026 | 0.0014 | | 0.2 | Yes |
| 113 | Comp. ex. | Bal. | 0.20 | 1.6 | 2.0 | 0.0253 | 0.0030 | 0.0017 | 0.0016 | | 0.1 | Yes |
| 114 | Comp. ex. | Bal. | 0.20 | 1.6 | 2.0 | 0.0210 | 0.0074 | 0.0013 | 0.0018 | | 0.3 | Yes |
| 115 | Comp. ex. | Bal. | 0.20 | 4.5 | 2.0 | 0.0014 | 0.0147 | 0.0023 | 0.0020 | | 0.2 | Yes |
| 116 | Comp. ex. | Bal. | 0.20 | 0 | 2.0 | 0.0015 | 0.0090 | 0.0024 | 0.0021 | | 0.1 | Yes |
| 117 | Comp. ex. | Bal. | 0.20 | 1.6 | 6.0 | 0.1002 | 0.0160 | 0.0011 | 0.0021 | | 0.1 | Yes |
| 118 | Comp. ex. | Bal. | 0.20 | 1.8 | 0 | 0.0299 | 0.0084 | 0.0010 | 0.0023 | | 0.1 | Yes |
| 119 | Comp. ex. | Bal. | 0.40 | 1.6 | 2.0 | 0.0501 | 0.0250 | 0.0016 | 0.0020 | | 9.2 | Yes |
| 120 | Ex. | Bal. | 0.20 | 3.0 | 2.0 | 0.0239 | 0.0040 | 0.0012 | 0.0018 | Ni: 0.90 | 0.1 | Yes |
| 121 | Ex. | Bal. | 0.20 | 1.8 | 5.0 | 0.0209 | 0.0120 | 0.0025 | 0.0019 | Cr: 1.00 | 0.2 | Yes |
| 122 | Ex. | Bal. | 0.20 | 1.0 | 2.3 | 0.0360 | 0.0090 | 0.0013 | 0.0017 | | 0.1 | Yes |
| 123 | Ex. | Bal. | 0.20 | 1.8 | 2.0 | 0.0380 | 0.0086 | 0.0025 | 0.0012 | | 0.2 | Yes |
| 124 | Ex. | Bal. | 0.25 | 1.5 | 2.3 | 0.0402 | 0.0160 | 0.0024 | 0.0025 | Ti: 0.030 | 0.2 | Yes |
| 125 | Ex. | Bal. | 0.25 | 1.5 | 2.0 | 0.0420 | 0.0108 | 0.0021 | 0.0021 | V: 0.050 | 0.1 | Yes |
| 126 | Ex. | Bal. | 0.30 | 1.5 | 2.3 | 0.0230 | 0.0132 | 0.0023 | 0.0020 | | 0.1 | Yes |

TABLE 1-continued

| | | | | | | | | | | | | |
|---|---|---|---|---|---|---|---|---|---|---|---|---|
| 127 | Ex. | Bal. | 0.30 | 1.8 | 0.3 | 0.0390 | 0.0081 | 0.0022 | 0.0018 | Nb: 0.020 | 0.1 | Yes |
| 128 | Ex. | Bal. | 0.35 | 1.8 | 3.0 | 0.0384 | 0.0043 | 0.0024 | 0.0016 | Cu: 0.01 | 0.3 | Yes |
| 129 | Ex. | Bal. | 0.35 | 1.8 | 2.0 | 0.0280 | 0.0088 | 0.0020 | 0.0034 | | 0.1 | Yes |
| 130 | Ex. | Bal. | 0.40 | 1.8 | 2.0 | 0.0265 | 0.0070 | 0.0022 | 0.0011 | Mo: 0.40 | 0.4 | Yes |
| 131 | Ex. | Bal. | 0.40 | 1.8 | 2.0 | 0.0161 | 0.0120 | 0.0017 | 0.0010 | W: 0.02 | 0.1 | Yes |
| 132 | Ex. | Bal. | 0.40 | 1.8 | 2.0 | 0.0170 | 0.0142 | 0.0015 | 0.0009 | Ca: 0.001 | 0.2 | Yes |
| 133 | Ex. | Bal. | 0.40 | 1.8 | 2.0 | 0.0280 | 0.0082 | 0.0011 | 0.0014 | | 0.1 | Yes |
| 134 | Comp. ex. | Bal. | 0.40 | 1.6 | 2.0 | 0.0341 | 0.0085 | 0.0017 | 0.0017 | | 0.1 | Yes |
| 135 | Comp. ex. | Bal. | 0.20 | 1.0 | 2.3 | 0.0310 | 0.0110 | 0.0021 | 0.0022 | | 0.2 | No |

| | | | | | Form of internal oxides | | |
|---|---|---|---|---|---|---|---|
| | | | | | Granular | | Grain |
| | Annealing conditions | | | | Average | Number | boundary |
| No. | Tension | Dew point (° C.) | Holding temp. (° C.) | Holding time (s) | grain size (nm) | density (/μm$^2$) | Ratio A (%) |
| 101 | Yes | 0 | 750 | 55 | — | 0 | 22 |
| 102 | Yes | 0 | 750 | 55 | 150 | 4.2 | 0 |
| 103 | Yes | 0 | 720 | 55 | 100 | 5.9 | 0 |
| 104 | Yes | 0 | 730 | 55 | 120 | 5.3 | 0 |
| 105 | Yes | 0 | 700 | 55 | 70 | 6.5 | 0 |
| 106 | Yes | 0 | 700 | 55 | 50 | 4.7 | 0 |
| 107 | Yes | 0 | 760 | 55 | 150 | 10.8 | 30 |
| 108 | Yes | 0 | 740 | 55 | 120 | 13.6 | 0 |
| 109 | Yes | −40 | 740 | 55 | — | 0 | 0 |
| 110 | Yes | 20 | 740 | 55 | 340 | 0.9 | 41 |
| 111 | Yes | 0 | 880 | 55 | 210 | 1.5 | 98 |
| 112 | Yes | 0 | 650 | 55 | 35 | 2.2 | 0 |
| 113 | Yes | 0 | 740 | 5 | — | 0 | 0 |
| 114 | Yes | 0 | 740 | 350 | 480 | 0.4 | 97 |
| 115 | Yes | 0 | 740 | 55 | 510 | 0.8 | 0 |
| 116 | Yes | 0 | 740 | 55 | — | 0 | 0 |
| 117 | Yes | 0 | 740 | 55 | 360 | 1.5 | 12 |
| 118 | Yes | 0 | 740 | 55 | — | 0 | 0 |
| 119 | Yes | 0 | 740 | 55 | — | 0 | 45 |
| 120 | Yes | 0 | 740 | 55 | 150 | 13.6 | 0 |
| 121 | Yes | 0 | 740 | 55 | 80 | 12.9 | 0 |
| 122 | Yes | 0 | 740 | 55 | 140 | 11.2 | 0 |
| 123 | Yes | 0 | 740 | 55 | 120 | 14.5 | 0 |
| 124 | Yes | 0 | 740 | 55 | 150 | 16.2 | 0 |
| 125 | Yes | 0 | 740 | 55 | 130 | 10.1 | 0 |
| 126 | Yes | 0 | 740 | 55 | 140 | 15.0 | 0 |
| 127 | Yes | 0 | 740 | 55 | 150 | 10.6 | 0 |
| 128 | Yes | 0 | 780 | 55 | 150 | 11.3 | 48 |
| 129 | Yes | 0 | 740 | 55 | 140 | 14.0 | 0 |
| 130 | Yes | 0 | 740 | 55 | 100 | 15.9 | 0 |
| 131 | Yes | 0 | 740 | 55 | 120 | 13.9 | 0 |
| 132 | Yes | 0 | 740 | 55 | 140 | 12.0 | 0 |
| 133 | Yes | 0 | 740 | 55 | 150 | 13.2 | 0 |
| 134 | No | 0 | 740 | 100 | 150 | 0.2 | 0 |
| 135 | Yes | 0 | 740 | 55 | 170 | 0.1 | 0 |

| | Si—Mn depleted layer | | | | Performance | | |
|---|---|---|---|---|---|---|---|
| | | Depletion rate (%) | | Plating | | Hydrogen embrittlement | |
| No. | Thickness (μm) | Si | Mn | type | Plateability | resistance | LME resistance |
| 101 | 4.4 | 22 | 31 | A | A | B | B |
| 102 | 3.8 | 2 | 3 | A | A | A | A |
| 103 | 3.5 | 3 | 4 | A | A | A | A |
| 104 | 3.3 | 2 | 3 | C: 1.5 | A | A | AAA |
| 105 | 3.2 | 1 | 2 | A | A | A | A |
| 106 | 3 | 3 | 3 | C: 1.2 | A | A | AAA |
| 107 | 3 | 3 | 4 | B | A | A | AA |
| 108 | 3.4 | 2 | 3 | C: 0.3 | A | A | AAA |
| 109 | — | — | — | A | B | B | B |
| 110 | 7.5 | 55 | 76 | A | B | B | B |
| 111 | 9.5 | 4 | 3 | A | A | B | B |
| 112 | 0.2 | 80 | 88 | A | A | B | B |
| 113 | 1.2 | 7 | 7 | A | A | B | B |
| 114 | 6.6 | 52 | 22 | A | A | B | B |
| 115 | 5.6 | 9 | 12 | A | B | B | B |
| 116 | 5.5 | — | 8 | A | A | B | B |
| 117 | 5.4 | 61 | 11 | A | B | B | B |
| 118 | — | — | — | A | A | B | B |

TABLE 1-continued

| | | | | | | | |
|---|---|---|---|---|---|---|---|
| 119 | 4.1 | 89 | 90 | A | A | B | B |
| 120 | 5.9 | 2 | 2 | A | A | A | AA |
| 121 | 5.4 | 3 | 1 | A | A | A | AA |
| 122 | 5.6 | 2 | 2 | C: 0.8 | A | A | AAA |
| 123 | 5.2 | 3 | 3 | A | A | A | AA |
| 124 | 5.6 | 4 | 2 | A | A | A | AA |
| 125 | 5.1 | 1 | 3 | B | A | A | AA |
| 126 | 5 | 2 | 1 | C: 0.4 | A | A | AAA |
| 127 | 5.6 | 3 | 3 | A | A | A | AA |
| 128 | 5.4 | 3 | 2 | C: 0.6 | A | A | AAA |
| 129 | 6.1 | 4 | 3 | A | A | A | AA |
| 130 | 4.5 | 3 | 2 | A | A | A | AA |
| 131 | 4.6 | 4 | 3 | A | A | A | AA |
| 132 | 4.3 | 5 | 4 | A | A | A | AA |
| 133 | 4.9 | 4 | 3 | A | A | A | AA |
| 134 | 8 | 34 | 53 | A | A | B | B |
| 135 | 1.8 | 44 | 54 | A | A | B | B |

In each of Sample Nos. 102 to 108 and 120 to 133, the chemical composition of the steel, the average grain size and number density of the granular oxides, and the thickness and composition of the Si—Mn depleted layer were suitable, so high plateability, hydrogen embrittlement resistance, and LME resistance were possessed. On the other hand, in each of Sample Nos. 101 and 119, the depth of the internal oxide layer before annealing was great, the desired granular oxides could not be formed, and the desired Si—Mn depleted layer was also not formed, so high hydrogen embrittlement resistance and LME resistance were not obtained. In Sample No. 109, the dew point at the time of annealing was low, not internal oxides, but an external oxidation layer was formed, and high plateability, hydrogen embrittlement resistance, and LME resistance were not obtained. In Sample No. 110, the dew point at the time of annealing was high, an external oxidation layer was formed, granular oxides could not be refined, and a high plateability, hydrogen embrittlement resistance, and LME resistance were not obtained. In Sample No. 111, the holding temperature at the time of annealing was high, formation of grain boundary oxides was promoted, granular oxides could not be refined, and a high hydrogen embrittlement resistance and LME resistance were not obtained. In Sample No. 112, the holding temperature at the time of annealing was low, internal oxides were not sufficiently formed, and the desired Si—Mn depleted layer was also not formed, so high hydrogen embrittlement resistance and LME resistance were not obtained. In Sample No. 113, the holding time at the time of annealing was short, internal oxides were not sufficiently formed, and the desired Si—Mn depleted layer was also not formed, so high hydrogen embrittlement resistance and LME resistance were not obtained. In Sample No. 114, the holding time at the time of annealing was long, formation of grain boundary oxides was promoted, granular oxides could not be refined, and high hydrogen embrittlement resistance and LME resistance were not obtained. In Sample Nos. 115 and 117, respectively the amount of Si and the amount of Mn were excessive and, in each, external oxides grew, further the granular oxides coarsened, and the desired Si—Mn depleted layer was also not formed, so a high plateability, hydrogen embrittlement resistance, and LME resistance were not obtained. In Sample Nos. 116 and 118, respectively the amount of Si and the amount of Mn were 0 (zero) and, in each, the internal oxidation layer was not formed, and the desired Si—Mn depleted layer was also not formed, so a high hydrogen embrittlement resistance and LME resistance were not obtained. In Sample No. 134, a predetermined tension was not applied at the time of annealing, so internal oxides were not sufficiently formed and the desired Si—Mn depleted layer was also not formed. As a result, high hydrogen embrittlement resistance and LME resistance were not obtained. In Sample No. 135, grinding before annealing was not performed, so internal oxides were not sufficiently formed and the desired Si—Mn depleted layer was also not formed. As a result, high hydrogen embrittlement resistance and LME resistance were not obtained.

Example Y (Preparation of Steel Sheet Samples)

Except for making the holding temperature at the annealing mainly more than 780° C., to 870° C., the same procedure was performed as the case of Example X to prepare a sample of the steel sheet under the production conditions shown in Table 2. For each of the samples of the steel sheet, a JIS No. 5 tensile test piece having the direction vertical to the rolling direction as the longitudinal direction was taken and a tensile test was performed based on JIS Z 2241(2011). As a result, for Nos. 201, 216, and 218, the tensile strength was less than 440 MPa. For the others, it was 440 MPa or more.

(Preparation of Samples of Plated Steel Sheet)

Each of the samples of steel sheets was cut to 100 mm×200 mm size, then was plated for forming the plating type shown in Table 2 to thereby prepare a sample of the plated steel sheet. In Table 2, the plating type A means "hot dip galvannealed steel sheet (GA)", the plating type B means "hot dip galvanized-0.2% Al-plated steel sheet (GI)", and the plating type C means "hot dip galvanized-(0.3 to 1.5)% Al-plated steel sheet (Al content described in Table 1)". In the hot dip galvanization step, the cut sample was dipped in a 440° C., hot dip galvanization bath for 3 seconds. After dipping, it was pulled out at 100 mm/s. $N_2$ wiping gas was used to control the amount of plating deposition to 50 g/m$^2$. For the plating type A, alloying was performed after that at 460° C.

The analysis of the surface layer of the sample of steel sheet, the analysis of the chemical composition of the plating layer, the evaluation of the plateability, the evaluation of the LME resistance, and the evaluation of the hydrogen embrittlement resistance were as explained above in relation to the Example X.

TABLE 2

| No. | Class | chemical composition (mass %) Fe | C | Si | Mn | Al | P | S | N | Others | Depth of internal oxidation layer before annealing (μm) | Grinding (heavy duty grinding brush) |
|---|---|---|---|---|---|---|---|---|---|---|---|---|
| 201 | Comp. ex. | Bal. | 0.03 | 1.8 | 2.0 | 0.0201 | 0.0090 | 0.0013 | 0.0024 | | 0.3 | Yes |
| 202 | Ex. | Bal. | 0.05 | 1.2 | 2.0 | 0.0133 | 0.0056 | 0.0146 | 0.0036 | | 0.2 | Yes |
| 203 | Ex. | Bal. | 0.10 | 2.1 | 2.0 | 0.1234 | 0.0118 | 0.0012 | 0.0023 | REM: 0.002 | 0.1 | Yes |
| 204 | Ex. | Bal. | 0.10 | 0.6 | 2.0 | 0.0117 | 0.0081 | 0.0025 | 0.0031 | Hf: 0.002 | 0.2 | Yes |
| 205 | Ex. | Bal. | 0.10 | 1.5 | 2.2 | 0.0240 | 0.0109 | 0.0024 | 0.0024 | B: 0.001 | 0.2 | Yes |
| 206 | Ex. | Bal. | 0.20 | 0.5 | 2.0 | 0.0212 | 0.0137 | 0.0017 | 0.0024 | Mg: 0.003 | 0.1 | Yes |
| 207 | Ex. | Bal. | 0.20 | 1.8 | 2.0 | 0.0150 | 0.0152 | 0.0029 | 0.0011 | Zr: 0.035 | 0.2 | Yes |
| 208 | Ex. | Bal. | 0.20 | 1.8 | 2.0 | 0.0160 | 0.0209 | 0.0019 | 0.0019 | | 0.1 | Yes |
| 209 | Comp. ex. | Bal. | 0.20 | 1.8 | 2.0 | 0.0199 | 0.0107 | 0.0014 | 0.0013 | | 0.1 | Yes |
| 210 | Comp. ex. | Bal. | 0.20 | 1.8 | 2.0 | 0.0311 | 0.0130 | 0.0013 | 0.0022 | | 0.1 | Yes |
| 211 | Comp. ex. | Bal. | 0.20 | 1.8 | 2.0 | 0.0032 | 0.0105 | 0.0023 | 0.0011 | | 0.3 | Yes |
| 212 | Comp. ex. | Bal. | 0.20 | 1.8 | 2.0 | 0.0066 | 0.0084 | 0.0026 | 0.0011 | | 0.1 | Yes |
| 213 | Comp. ex. | Bal. | 0.20 | 1.8 | 2.0 | 0.0253 | 0.0023 | 0.0018 | 0.0017 | | 0.3 | Yes |
| 214 | Comp. ex. | Bal. | 0.20 | 1.8 | 2.0 | 0.0235 | 0.0076 | 0.0015 | 0.0019 | | 0.3 | Yes |
| 215 | Comp. ex. | Bal. | 0.20 | 4.4 | 2.0 | 0.0017 | 0.0143 | 0.0027 | 0.0016 | | 0.1 | Yes |
| 216 | Comp. ex. | Bal. | 0.20 | 0 | 2.0 | 0.0015 | 0.0090 | 0.0022 | 0.0022 | | 0.1 | Yes |
| 217 | Comp. ex. | Bal. | 0.20 | 1.7 | 6.0 | 0.1002 | 0.0166 | 0.0011 | 0.0021 | | 0.1 | Yes |
| 218 | Comp. ex. | Bal. | 0.20 | 1.7 | 0 | 0.0312 | 0.0084 | 0.0010 | 0.0023 | | 0.1 | Yes |
| 219 | Comp. ex. | Bal. | 0.40 | 1.5 | 2.0 | 0.0501 | 0.0233 | 0.0013 | 0.0020 | | 2.5 | Yes |
| 220 | Ex. | Bal. | 0.20 | 2.5 | 2.5 | 0.0255 | 0.0034 | 0.0010 | 0.0022 | Cr: 1.00 | 0.2 | Yes |
| 221 | Ex. | Bal. | 0.20 | 3.0 | 2.3 | 0.0221 | 0.0110 | 0.0027 | 0.0013 | Cu: 0.01 | 0.2 | Yes |
| 222 | Ex. | Bal. | 0.20 | 1.0 | 5.0 | 0.0311 | 0.0089 | 0.0044 | 0.0017 | Ti: 0.030 | 0.1 | Yes |
| 223 | Ex. | Bal. | 0.20 | 1.8 | 2.0 | 0.0334 | 0.0099 | 0.0021 | 0.0012 | Ni: 0.90 | 0.1 | Yes |
| 224 | Ex. | Bal. | 0.25 | 1.8 | 2.0 | 0.0401 | 0.0099 | 0.0024 | 0.0012 | | 0.1 | Yes |
| 225 | Ex. | Bal. | 0.25 | 1.8 | 2.0 | 0.0224 | 0.0100 | 0.0021 | 0.0015 | Nb: 0.017 | 0.1 | Yes |
| 226 | Ex | Bal. | 0.30 | 1.8 | 2.0 | 0.0222 | 0.0131 | 0.0021 | 0.0021 | V: 0.046 | 0.1 | Yes |
| 227 | Ex. | Bal. | 0.30 | 1.5 | 0.3 | 0.0267 | 0.0111 | 0.0021 | 0.0024 | | 0.1 | Yes |
| 228 | Ex. | Bal. | 0.35 | 1.5 | 3.0 | 0.0312 | 0.0109 | 0.0021 | 0.0022 | Mo: 0.08 | 0.2 | Yes |
| 229 | Ex. | Bal. | 0.35 | 1.5 | 2.0 | 0.0367 | 0.0099 | 0.0015 | 0.0021 | W: 0.01 | 0.1 | Yes |
| 230 | Ex. | Bal. | 0.40 | 1.5 | 2.0 | 0.3999 | 0.0076 | 0.0014 | 0.0015 | | 0.4 | Yes |
| 231 | Ex. | Bal. | 0.40 | 1.5 | 2.0 | 0.0242 | 0.0113 | 0.0018 | 0.0011 | | 0.1 | Yes |
| 232 | Ex. | Bal. | 0.40 | 1.5 | 2.0 | 0.0173 | 0.0142 | 0.0016 | 0.0017 | | 0.1 | Yes |
| 233 | Ex. | Bal. | 0.40 | 1.5 | 2.0 | 0.0288 | 0.0082 | 0.0014 | 0.0017 | Ca: 0.001 | 0.1 | Yes |
| 234 | Comp. ex. | Bal. | 0.40 | 1.6 | 2.0 | 0.0332 | 0.0111 | 0.0021 | 0.0016 | | 0.1 | Yes |
| 235 | Comp. ex. | Bal. | 0.20 | 1.0 | 2.3 | 0.0326 | 0.0114 | 0.0023 | 0.0023 | | 0.2 | No |

| No. | Annealing conditions Tension | Dew point (° C.) | Holding temp. (° C.) | Holding time (s) | Form of internal oxides: Granular Average grain size (nm) | Granular Number density (/μm²) | Grain boundary Ratio A (%) |
|---|---|---|---|---|---|---|---|
| 201 | Yes | 0 | 840 | 120 | 210 | 2.0 | 0 |
| 202 | Yes | 0 | 840 | 80 | 250 | 4.2 | 89 |
| 203 | Yes | 0 | 840 | 80 | 210 | 6.1 | 88 |
| 204 | Yes | 0 | 800 | 80 | 240 | 5.0 | 85 |
| 205 | Yes | 0 | 840 | 80 | 170 | 5.4 | 84 |
| 206 | Yes | 0 | 840 | 80 | 150 | 4.1 | 86 |
| 207 | Yes | 0 | 820 | 120 | 250 | 10.2 | 100 |
| 208 | Yes | 0 | 840 | 120 | 230 | 14.1 | 95 |
| 209 | Yes | −40 | 840 | 120 | — | 0 | 0 |
| 210 | Yes | 20 | 840 | 120 | 310 | 1.1 | 38 |
| 211 | Yes | 0 | 980 | 120 | 290 | 1.0 | 5 |
| 212 | No | 0 | 700 | 120 | 220 | 10.6 | 0 |
| 213 | Yes | 0 | 840 | 35 | — | 0 | 52 |
| 214 | Yes | 0 | 840 | 350 | 380 | 4.4 | 97 |
| 215 | Yes | 0 | 840 | 120 | 510 | 1.5 | 0 |
| 216 | Yes | 0 | 840 | 120 | — | 0 | 0 |
| 217 | Yes | 0 | 840 | 120 | 370 | 1.2 | 10 |
| 218 | Yes | 0 | 840 | 120 | — | 0 | 0 |
| 219 | Yes | 0 | 840 | 120 | — | 0 | 39 |
| 220 | Yes | 0 | 840 | 120 | 160 | 13.1 | 100 |
| 221 | Yes | 0 | 840 | 120 | 200 | 12.9 | 93 |
| 222 | Yes | 0 | 840 | 120 | 150 | 11.0 | 91 |
| 223 | Yes | 0 | 840 | 120 | 130 | 15.2 | 95 |
| 224 | Yes | 0 | 860 | 120 | 170 | 16.3 | 90 |
| 225 | Yes | 0 | 840 | 120 | 190 | 10.7 | 82 |
| 226 | Yes | 0 | 840 | 80 | 150 | 14.8 | 89 |
| 227 | Yes | 0 | 840 | 80 | 220 | 10.0 | 95 |
| 228 | Yes | 0 | 840 | 80 | 160 | 11.4 | 96 |
| 229 | Yes | 0 | 840 | 55 | 170 | 13.6 | 66 |
| 230 | Yes | 0 | 800 | 80 | 180 | 14.8 | 80 |

TABLE 2-continued

| | | | | | | | |
|---|---|---|---|---|---|---|---|
| 231 | Yes | 0 | 840 | 80 | 200 | 14.5 | 89 |
| 232 | Yes | 0 | 860 | 80 | 250 | 11.9 | 88 |
| 233 | Yes | 0 | 840 | 80 | 240 | 13.4 | 85 |
| 234 | No | 0 | 840 | 360 | 360 | 4.1 | 100 |
| 235 | Yes | 0 | 840 | 80 | 220 | 0.4 | 0 |

| | Si—Mn depleted layer | | | | Performance | | |
|---|---|---|---|---|---|---|---|
| | Thickness | Depletion rate (%) | | Plating | | Hydrogen embrittlement | LME |
| No. | (μm) | Si | Mn | type | Plateability | resistance | resistance |
| 201 | 0.5 | 20 | 25 | A | A | B | B |
| 202 | 6.5 | 3 | 4 | A | A | A | A |
| 203 | 6.7 | 5 | 6 | A | A | A | A |
| 204 | 6.9 | 7 | 2 | A | A | A | A |
| 205 | 6.3 | 2 | 5 | B | A | A | A |
| 206 | 7.7 | 5 | 7 | A | A | A | A |
| 207 | 6.5 | 2 | 3 | B | A | A | A |
| 208 | 6.3 | 2 | 3 | C: 0.3 | A | A | AA |
| 209 | — | — | — | A | B | B | B |
| 210 | 8.1 | 65 | 70 | A | B | B | B |
| 211 | 10.5 | 20 | 23 | A | B | B | B |
| 212 | 1.00 | 4 | 9 | A | A | B | A |
| 213 | 3.1 | 12 | 18 | A | A | B | B |
| 214 | 14.8 | 8 | 24 | A | A | B | B |
| 215 | 1.5 | 80 | 76 | A | B | B | B |
| 216 | — | — | — | A | A | B | B |
| 217 | 7.1 | 76 | 65 | A | B | B | B |
| 218 | — | — | — | A | A | B | B |
| 219 | 4 | 96 | 95 | A | A | B | B |
| 220 | 5.5 | 2 | 2 | A | A | AA | A |
| 221 | 4.2 | 3 | 1 | C: 0.8 | A | A | AA |
| 222 | 9.2 | 2 | 3 | C: 1.5 | A | AA | AA |
| 223 | 7.2 | 3 | 2 | A | A | AA | A |
| 224 | 7.5 | 2 | 1 | A | A | AA | A |
| 225 | 7.4 | 3 | 2 | A | A | AA | A |
| 226 | 7.1 | 7 | 6 | A | A | AA | A |
| 227 | 5.5 | 9 | 7 | C: 0.6 | A | A | AA |
| 228 | 8.5 | 5 | 8 | C: 0.9 | A | AA | AA |
| 229 | 7.4 | 6 | 3 | A | A | AA | A |
| 230 | 7 | 7 | 2 | A | A | AA | A |
| 231 | 7.6 | 3 | 4 | A | A | AA | A |
| 232 | 7.1 | 4 | 6 | A | A | A | A |
| 233 | 7.9 | 5 | 7 | A | A | A | A |
| 234 | 12.1 | 45 | 38 | A | A | B | B |
| 235 | 2 | 95 | 98 | A | A | B | B |

In each of Sample Nos. 202 to 208 and 220 to 233, the chemical composition of the steel sheet, the average grain size and number density of the granular oxides, and the thickness and composition of the Si—Mn depleted layer were suitable, so high plateability. LME resistance, and hydrogen embrittlement resistance were possessed. In Sample No. 201, the amount of C was insufficient and a sufficient strength was not obtained. Not only that the desired granular oxides were not formed and the desired Si—Mn depleted layer was also not formed, so high hydrogen embrittlement resistance and LME resistance were not obtained. In Sample No. 209, the dew point at the time of annealing was low and not internal oxides, but an external oxidation layer was formed, and high plateability, hydrogen embrittlement resistance, and LME resistance were not obtained. In Sample No. 210, the dew point at the time of annealing was high, an external oxidation layer was formed, granular oxides could not be refined, and high plateability, hydrogen embrittlement resistance, and LME resistance were not obtained. In Sample No. 211, the holding temperature at the time of annealing was high, external oxides were formed, granular oxides were not sufficiently formed, and the desired Si—Mn depleted layer was also not formed, so high plateability, hydrogen embrittlement resistance, and LME resistance were not obtained. In Sample No. 212, a predetermined tension was not applied at the time of annealing, so the desired Si—Mn depleted layer was not formed, and high hydrogen embrittlement resistance was not obtained. In Sample No. 213, the holding time at the time of annealing was short, internal oxides were not sufficiently formed, and the desired Si—Mn depleted layer was also not formed, so high hydrogen embrittlement resistance and LME resistance were not obtained. In each of Sample Nos. 214 and 234, the holding time at the time of annealing was long, granular oxides could not be refined, and the desired Si—Mn depleted layer was also not formed, so high hydrogen embrittlement resistance and LME resistance were not obtained. In Sample Nos. 215 and 217, the respective Si content and Mn content were excessive and, in each, the external oxides grew, further the granular oxides coarsened, and the desired Si—Mn depleted layer was also not formed, so high plateability, hydrogen embrittlement resistance, and LME resistance were not obtained. In Sample Nos. 216 and 218, the respective Si amount and Mn amount were 0 (zero) and in each an internal oxidation layer was not sufficiently formed and the desired Si—Mn depleted layer was also not formed, so high hydrogen embrittlement resistance and LME resistance were not obtained. In Sample No. 219, the depth of the internal oxide layer before annealing was great, the desired internal oxides could not be formed after annealing, and the desired Si—Mn depleted layer was also not formed, so high hydrogen embrittlement resistance and LME resistance were not obtained. In Sample No. 235, grinding was not performed before annealing, so internal oxides were not sufficiently formed and the desired Si—Mn depleted layer was also not formed. As a result, high hydrogen embrittlement resistance and LME resistance were not obtained.

INDUSTRIAL APPLICABILITY

According to the present invention, high strength steel sheet and plated steel sheet having a high plateability, LME resistance, and hydrogen embrittlement resistance can be provided. The steel sheet and plated steel can be suitably used for automobiles, home electric appliances, building materials, and other applications, in particular for automobiles. As steel sheet for automobile use and plated steel sheet for automobile use, higher collision safety and longer life can be expected. Therefore, the present invention can be said to be extremely high in value in industry.

REFERENCE NOTATIONS

1 steel sheet
2 external oxidation layer
3 base steel
11 steel sheet
12 granular oxides
13 grain boundary oxides
14 base steel

The invention claimed is:

1. A steel sheet having a chemical composition comprising, by mass %,
C: 0.05 to 0.40%,
Si: 0.2 to 3.0%,
Mn: 0.1 to 5.0%,
sol. Al: 0 to less than 0.4000%,
P: 0.0300% or less,
S: 0.0300% or less,
N: 0.0100% or less,
B: 0 to 0.010%,
Ti: 0 to 0.150%,
Nb: 0 to 0.150%,
V: 0 to 0.150%,
Cr: 0 to 2.00%,
Ni: 0 to 2.00%,
Cu: 0 to 2.00%,
Mo: 0 to 1.00%,
W: 0 to 1.00%,
Ca: 0 to 0.100%,
Mg: 0 to 0.100%,
Zr: 0 to 0.100%,
Hf: 0 to 0.100%,
REM: 0 to 0.100% and
a balance of Fe and impurities, wherein
a surface layer of the steel sheet contains granular oxides,
an average grain size of the granular oxides is 300 nm or less,
a number density of the granular oxides is 4.0/μm$^2$ or more,
the steel sheet comprises an Si—Mn depleted layer having a thickness of 3.0 μm or more from the surface of the steel sheet, and
Si and Mn contents of the Si—Mn depleted layer at ½ position of the thickness and not containing oxides are respectively less than 10% of the Si and Mn contents at a sheet thickness center part of the steel sheet.

2. The steel sheet according to claim 1, wherein the average grain size of the granular oxides is 200 nm or less.

3. The steel sheet according to claim 1, wherein the number density of the granular oxides is 10.0/μm$^2$ or more.

4. The steel sheet according to claim 1, wherein the surface layer of the steel sheet further contains grain boundary oxides.

5. The steel sheet according to claim 4, wherein, when examining a cross-section of the surface layer of the steel sheet, a Ratio A of a length of the grain boundary oxides projected on the surface of the steel sheet to a length of the surface of the steel sheet is 50% or more.

6. The steel sheet according to claim 5, wherein the Ratio A is 80% or more.

7. A plated steel sheet having a plating layer including Zn on the steel sheet of claim 1.

8. The plated steel sheet according to claim 7, wherein the plating layer has a chemical composition of Zn-(0.3 to 1.5)% Al.

9. The steel sheet according to claim 2, wherein the number density of the granular oxides is 10.0/μm$^2$ or more.

10. The steel sheet according to claim 2, wherein the surface layer of the steel sheet further contains grain boundary oxides.

11. The steel sheet according to claim 3, wherein the surface layer of the steel sheet further contains grain boundary oxides.

12. A plated steel sheet having a plating layer including Zn on the steel sheet of claim 2.

13. A plated steel sheet having a plating layer including Zn on the steel sheet of claim 3.

14. A plated steel sheet having a plating layer including Zn on the steel sheet of claim 4.

15. A plated steel sheet having a plating layer including Zn on the steel sheet of claim 5.

16. A plated steel sheet having a plating layer including Zn on the steel sheet of claim 6.

* * * * *